United States Patent [19]

Tanikawa et al.

[11] Patent Number: 4,999,272

[45] Date of Patent: Mar. 12, 1991

[54] ELECTROPHOTOGRAPHIC ANALOG AND DIGITAL IMAGING AND DEVELOPING USING MAGNETIC TONER

[75] Inventors: Hirohide Tanikawa, Yokohama; Toshiaki Nakahara, Tokyo; Satoshi Yoshida, Kawasaki; Masatsugu Fujiwara, Yokohama; Kiichiro Sakashita, Tokyo, all of Japan

[73] Assignee: Canon Kabushiki Kaisha, Tokyo, Japan

[21] Appl. No.: 398,502

[22] Filed: Aug. 25, 1989

[30] Foreign Application Priority Data

Aug. 31, 1988 [JP] Japan ..... 63-215160

[51] Int. Cl.[5] ..... G03G 13/09

[52] U.S. Cl. ..... 430/106.6; 430/111; 430/122; 430/903

[58] Field of Search ..... 430/122, 106.6, 111, 430/903

[56] References Cited

U.S. PATENT DOCUMENTS

| | | | |
|---|---|---|---|
| 4,284,701 | 8/1981 | Abbott et al. | 430/111 |
| 4,666,813 | 5/1987 | Sakashita | 430/110 |
| 4,885,222 | 12/1989 | Kaneko et al. | 430/122 X |
| 4,957,840 | 9/1990 | Sakashita et al. | 430/106 |

OTHER PUBLICATIONS

Patent Abstracts of Japan, vol. 7, No. 196 (P-219) (1341), Aug. 26, 1983 & JP-A-58 95748 (Hitachi), Jun. 7, 1983.

*Primary Examiner*—David Welsh

*Attorney, Agent, or Firm*—Fitzpatrick, Cella, Harper & Scinto

[57] ABSTRACT

An image forming method, comprising the steps of: providing an electrophotographic photosensitive member comprising an organic photoconductor, and a toner-carrying member carrying thereon a magnetic toner disposed opposite to the photosensitive member with a predetermined clearance in a developing region; the photosensitive member comprising at least two species of charge-generating substances and carrying thereon a digital and an analog electrostatic images; carrying the magnetic toner on the toner-carrying member to the developing region while regulating the magnetic toner so as to provide a thickness smaller than the clearance, the magnetic toner having a specific particle size distribution and a volume-average particle size of 4–10 microns; and developing the electrostatic images with the magnetic toner.

18 Claims, 7 Drawing Sheets

ELECTROPHOTOGRAPHIC ANALOG AND DIGITAL IMAGING AND DEVELOPING USING MAGNETIC TONER

FIELD OF THE INVENTION AND RELATED ART

The present invention relates to an image forming method comprising a step of developing an electrostatic latent image to be formed in electrophotography, electrostatic recording, and the like, by use of a magnetic toner.

Hitherto, as the method for forming an electrostatic latent image, there have been known an analog system (or mode) wherein an original is illuminated with an exposure means such as halogen lamp and the resultant reflection light is focused on an electrostatic latent image-bearing member; and a digital system wherein an electrostatic latent image-bearing member is directly illuminated with laser light, LED light, etc., thereby to form thereon a latent image.

A normal developing method for developing these electrostatic latent images with a one component-type magnetic toner has been proposed in e.g., Japanese Laid-Open Patent Application (KOKAI) Nos. 18656/1980 and 18659/1980.

In the above-mentioned developing method, an insulating magnetic toner is uniformly applied onto a cylindrical toner-carrying member containing therein a magnet, the resultant toner layer formed on the toner-carrying member is opposed to an latent image-bearing member without contacting it, and in a developing zone, the insulating magnetic toner is transferred from the toner-carrying member to the latent image-bearing member to develop an electrostatic latent image formed thereon. In a case where an alternating voltage is applied between the toner-carrying member and the substrate conductor of the latent image-bearing member and the toner is reciprocated between the toner-carrying member and the latent image-bearing member, good development may be effected so as to provide excellent gradation reproducibility without ground fog or thinning of the end portion of the resultant image. In such a developing method, electrostatic transfer is easily effected because the toner used is insulating.

There is a method wherein a blade for application is disposed at the outlet of a toner container in order to form a toner layer on a toner-carrying member. For example, in a developing device as shown in FIG. 1, a blade 1*a* comprising a magnetic material is disposed opposite to a magnetic pole $N_1$ of a fixed magnet 4 contained in a toner-carrying member 2 so that ears comprising magnetic toner particles are erected along the magnetic lines of force formed between the above-mentioned magnetic pole and the magnetic blade, and the ears of the magnetic toner particles are cut with the edge portion of the blade tip. Thus, the thickness of the toner layer is regulated by utilizing the function of magnetic force as described in, e.g., Japanese Laid-Open Patent Application No. 43037/1979.

In FIG. 1, reference numeral 7 denotes a developing container containing a toner 10, and numeral 9 denotes a latent image-bearing member such as photosensitive drum for electrophotography or an insulating drum for electrostatic recording (hereinafter, referred to as "photosensitive member" or "photosensitive drum").

With respect to an analog latent image and a digital latent image, the methods for formation thereof are different from each other, and suitable surface potentials of the latent image corresponding to these latent images are also different from each other. In a developing method for effecting both the analog and digital developments, particularly in a method for effecting both of these in one pass (i.e., a method for developing both digital and analog latent images in one developing operation), many problems which have not been known in the prior art can be encountered.

More specifically, a digital latent image may generally be formed by charging an electrostatic latent image-bearing member, illuminating it with a light source such as laser light to decrease the surface potential of the illuminated portion thereof, and providing a potential contrast. In order to develop the thus formed latent image, a portion of the latent image-bearing member having either one of a light part potential ($V_L$) or a dark part potential ($V_D$) may be developed. In the normal development, toner particles may be attached to a portion having a relatively high potential ($V_D$). On the other hand, in the reversal development, toner particles may be attached to a portion having a relatively low potential.

Hereinbelow, there is described a case wherein the normal development is effected.

For example, a portion of a latent image-bearing member having a low potential is caused to have a light part potential ($V_L$) and a portion thereof having a high potential is caused to have a dark part potential ($V_D$). When a developing operation is conducted in such a case, the portion having $V_L$ (hereinafter referred to as "$V_L$ portion") is visualized as a white image, and the portion having $V_D$ (hereinafter, referred to as "$V_D$ portion") is visualized as a black image. In this case, it is preferred that the $V_D$ portion is selectively developed. If the $V_L$ portion is also developed, fog appears in the resultant image. In the $V_L$ portion, the surface potential is decreased by using exposure means such as laser spots, but in practice, the potential of a portion between these spots is not necessarily decreased sufficiently, whereby a variation in the surface potential can occur. Accordingly, a portion having a relatively high potential can occur in the $V_L$ portion and can be visualized as streak-like fog. On the other hand, in the digital latent image, a half-tone image is indicated by the number of dots per unit area and/or density of lines. Accordingly, in general, it is unnecessary to develop a medium potential so as to visualize a portion having a half-tone potential.

In a case where the digital latent image is developed by using the above-mentioned developing method, the gradation reproducibility (or tone reproduction) corresponding to a medium potential is not important, but there is required a magnetic toner such that it can sufficiently develop a portion in the neighborhood of the $V_D$ portion but does not substantially develop a portion having a low potential in the neighborhood of the $V_L$ portion.

However, in the developing method using the conventional magnetic toner, there occurs a problem such that a curve obtained by plotting image densities against surface potentials shows a relatively small slope in the neighborhood of the $V_L$ portion and $V_D$ portion, as shown in FIGS. 2 and 3.

In the development of a digital latent image, if a portion having a somewhat high potential in the neighborhood of the $V_D$ portion is developed, toner particles are also attached to such a portion. In order to prevent such a phenomenon, it is necessary to use a developing method wherein developing conditions are set so that the slope of the image density-surface potential curve is increased and the effect of the density curve does not appear as shown in FIG. 2 (hereinafter, such a developing method is referred to as "developing method A").

On the other hand, an analog latent image may generally be formed by charging an electrostatic latent image-bearing member, and decreasing the surface potential thereof corresponding to the density of an original by using the reflection light from the original as a light source, thereby to provide a potential contrast.

For example, a portion of a latent image-bearing member having a low potential is caused to have $V_L$, a portion thereof having a high potential is caused to have $V_D$, and a portion thereof having a medium potential is caused to have a half-tone potential ($V_H$). When a developing operation is conducted in such a case, the $V_L$ portion is visualized as a white image, the $V_D$ portion is visualized as a black image, and the portion having $V_H$ (hereinafter, referred to as "$V_H$ portion") is visualized as a half-tone image. Since the visualization of the half-tone latent image is directly influenced by the surface potential, it is necessary to develop the respective potentials so as to provide good gradation characteristic.

When an analog latent image is visualized by using the above-mentioned developing method, the gradation reproducibility corresponding to the medium potential also becomes important. Accordingly, when the analog latent image is developed, there is used a developing method wherein developing conditions are set so that the slope of the image density-surface potential curve is decreased and a gradation characteristic may be obtained as shown in FIG. 3 (hereinafter, such a developing method is referred to as "developing method B").

When the slope of the potential-density curve is decreased so as to improve the gradation reproducibility, the curve trailed toward the $V_L$ and $V_D$ portions as shown in FIG. 3. In the case of an analog latent image, the non-image portion is illuminated with reflection light having a constant intensity from an original to uniformly decrease its potential, whereby in general, fog is less liable to occur.

However, the above-mentioned developing method B is applied to a digital latent image, fog tends to occur in the $V_L$ portion since the slope of the potential-density curve is trailed in the neighborhood of $V_L$.

On the other hand, the above-mentioned developing method A is applied to an analog latent image, the resultant image density is considerably changed corresponding to a slight change in potential, since the slope of the potential-density curve is large. As a result, the reproducibility in a half-tone image is deteriorated, whereby a good gradation characteristic cannot be obtained.

In the prior art, since an analog latent image is formed by using visible light having a wavelength of 400–700 nm, a photosensitive drum having a spectral sensitivity in such a wavelength region has been used.

On the other hand, in a case where a digital latent image is formed by using a light source such as semiconductor laser, a photosensitive drum having a spectral sensitivity in an infrared region in the neighborhood of 800 nm has been used.

It is difficult to prepare a photosensitive drum which not only has both of these spectral sensitivities but also has sufficient electrophotographic characteristics such as charging characteristic, residual potential characteristic, and dark decay characteristic. Further, there has not been proposed a toner suitable for such a photosensitive drum. Accordingly, in the conventional image forming method, it is difficult to well develop both digital and analog latent images by means of the same image forming apparatus.

SUMMARY OF THE INVENTION

An object of the present invention is to solve the above-mentioned problems and to provide an image-forming method using a developing method capable of visualizing digital and analog latent images by use of a one-component magnetic developer.

Another object of the present invention is to provide an image-forming method capable of visualizing digital and analog latent images simultaneously.

A further object of the present invention is to provide an image-forming method capable of visualizing digital and analog latent images so as to provide a high image density and excellent representation dots and/or lines without causing fog.

A further object of the present invention is to provide an image-forming method capable of visualizing an analog latent image so as to provide excellent gradation characteristic.

A still further object of the present invention is to provide a magnetic toner suitably used in the above-mentioned image-forming method.

According to the present invention, there is provided an image forming method, comprising:

providing an electrophotographic photosensitive member comprising an organic photoconductor, and a toner-carrying member carrying thereon a magnetic toner disposed opposite to the photosensitive member with a predetermined clearance in a developing region; the photosensitive member comprising at least two species of charge-generating substances and carrying thereon a digital and an analog electrostatic images;

carrying the magnetic toner on the toner-carrying member to the developing region while regulating the magnetic toner so as to provide a thickness smaller than the clearance; the magnetic toner having a particle size distribution such that it comprises 12–60% by number of magnetic toner particles having a particle size of 5 microns or smaller, 1–33% by number of magnetic toner particles having a particle size of 8–12.7 microns, and 2.0% by volume or less of magnetic toner particles having a particle size of 16 microns or larger, and has a volume-average particle size of 4–10 microns; and developing the electrostatic images with said magnetic toner.

According to the present invention, there is provided a photosensitive drum not only having uniform spectral sensitivities to various lights including white light to long-wavelength light, which are suitable for forming digital and analog latent images, but also having a high sensitivity and excellent electrophotographic characteristics. As a result, there can be provided an image forming apparatus incorporating therein compound or complex functions of an electrophotographic copying machine and a laser printer. According to the image forming method of the present invention, a digital latent image may be developed without causing fog and an analog latent image may be developed so as to provide good gradation characteristic, whereby each of these latent images may be visualized.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
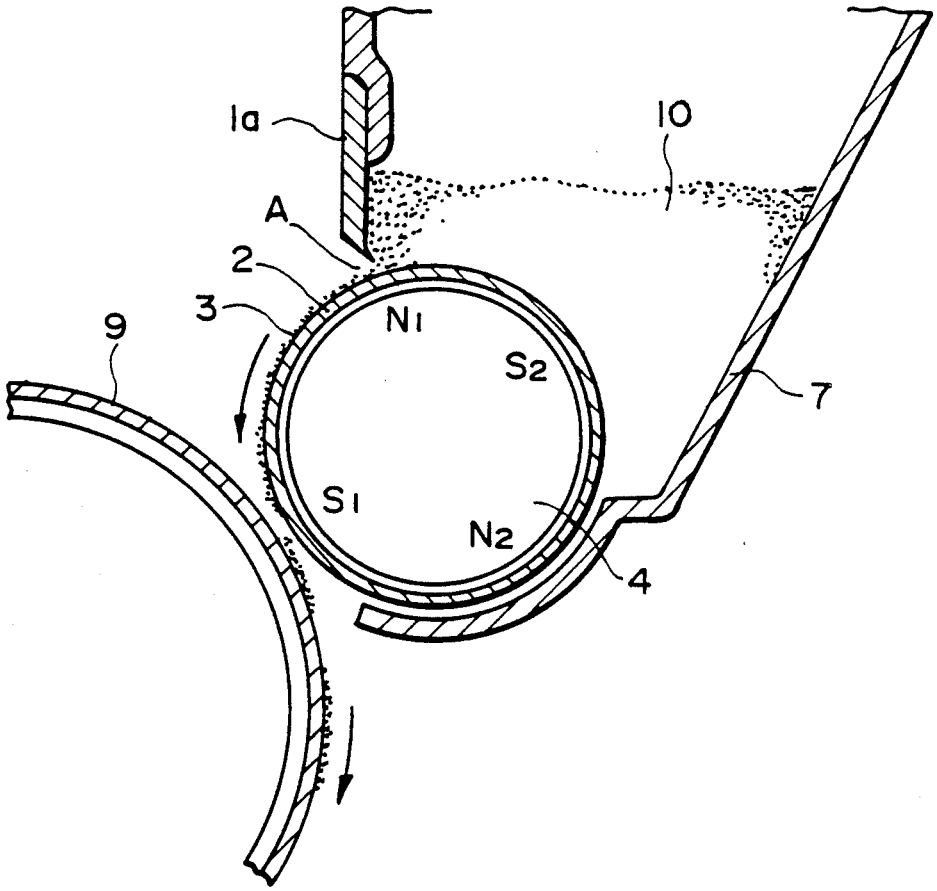
FIG. 1 is a schematic sectional view showing a developing device using a magnetic blade.
Figure 2:
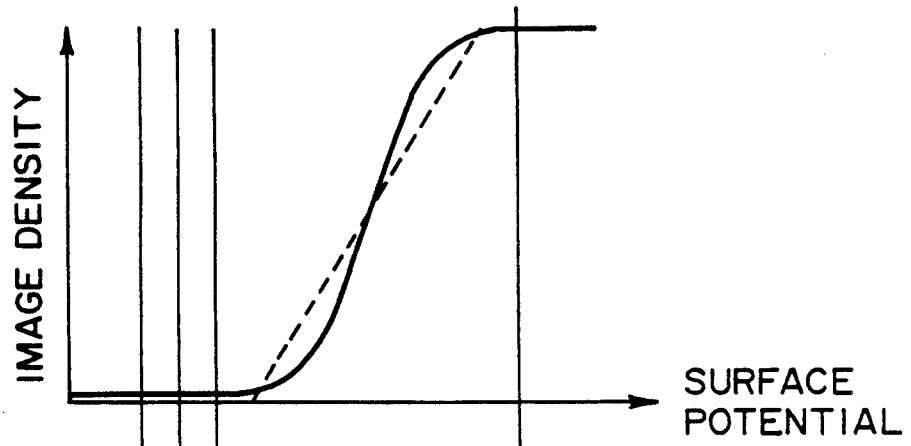
FIGS. 2, 3 and 4 are views each illustrating a relationship between image density and surface potential of a photosensitive member.
Figure 3:
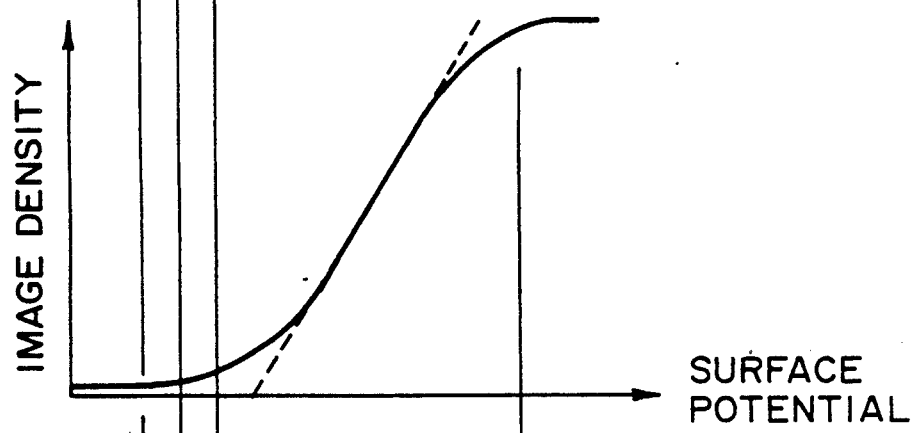

The electrostatic image-bearing member according to the present invention comprises a photosensitive member comprising an organic photoconductor (OPC). The photosensitive member may preferably comprise an electroconductive substrate and a photosensitive layer comprising at least a charge-generating substance and a charge-transporting substance. In the present invention, the photosensitive layer comprises at least two species of compounds as the charge-generating substance.

More specifically, in the present invention, the photosensitive layer may preferably be function-separated into a charge generation layer and a charge transport layer. The photosensitive member used in the present invention may preferably comprise an electroconductive substrate, and a charge generation layer and a charge transport layer disposed in this order on the support. The photosensitive layer may preferably comprise a charge generation layer comprising a binder and at least two species of charge-generating substances, and a charge transport layer comprising a binder and a charge-transporting substance.

In the charge generation layer, the charge-generating substance may preferably be used in an amount of 20–500 wt. parts, more preferably 50–200 wt. parts per 100 wt. parts of the binder. In the charge transport layer, the charge-transporting substance may preferably be used in an amount of 20–500 wt. parts, more preferably 50–200 wt. parts per 100 wt. parts of the binder. The charge generation layer may preferably have a thickness of 0.01–5 microns, and a charge transport layer may preferably have a thickness of 10–40 microns.

In the above-mentioned photosensitive member comprising an organic photoconductor, the charge-generating substance may preferably comprise a compound having a spectral sensitivity in a visible light region (not shorter than 400 nm and shorter than 700 nm) and a compound having a spectral sensitivity in an infrared light region (not shorter than 700 nm and not longer than 900 nm). The charge-transporting substance to be contained in the photosensitive layer and may preferably be a type such that its ionization potential and electric potential match those of the above-mentioned charge-generating substance and it is excellent in sensitivity, residual potential and charging characteristics. Such a photosensitive member comprising an organic photoconductor may suitably be used as an electrostatic latent image-bearing member having a spectral sensitivity in a region of from visible light to laser light.

In the photosensitive layer according to the present invention, the above-mentioned compounds for visible light and infrared radiation may preferably be used so that the weight ratio of (compound for visible light-/compound for infrared radiation) is 5/1 to 1/5, more preferably 3/1 to 1/3.

When the above-mentioned electrostatic image-bearing member is used, an analog latent image based on white reflection light supplied from an original and a digital latent image based on laser spots supplied from a semiconductor laser, etc., may be formed on the electrostatic image-bearing member.

Preferred examples of the charge-generating substance include a combination of a bisazo-type pigment showing an absorption peak on a shorter wavelength side, and a bisazo-type pigment showing an absorption peak on a longer wavelength side.

The bisazo-type pigment showing an absorption peak on a shorter wavelength side may preferably include one containing a oxadiazole ring as a central skeleton. Preferred examples thereof may include a bisazo-type pigment represented by the following formula (1).

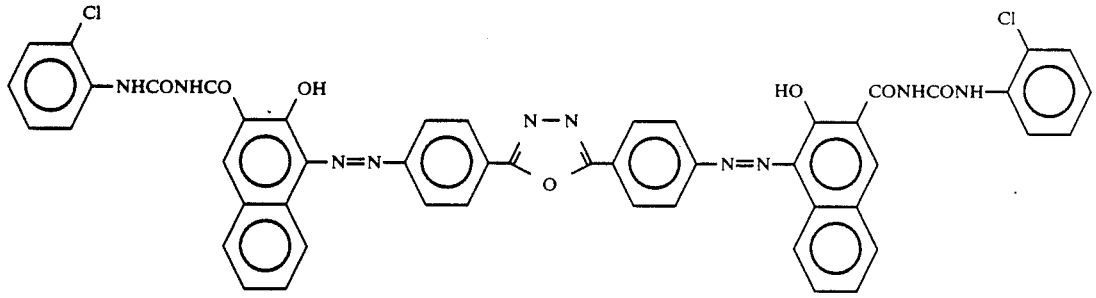

(1)

The bisazo-type pigment showing an absorption peak on a longer wavelength side may preferably include one containing a benzanthrone ring as a central skeleton, or one containing diphenyl-pyridine-2-yl amine as a central skeleton. Preferred examples thereof may include a bisazo pigment represented by the following formula (2) or (3).

(2)

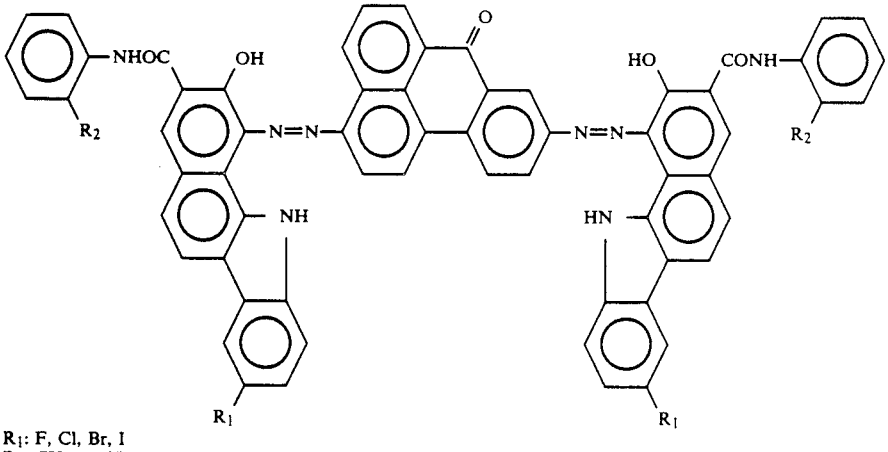

$R_1$: F, Cl, Br, I
$R_2$: $CH_3$, $-CH_2CH_3$ (3)

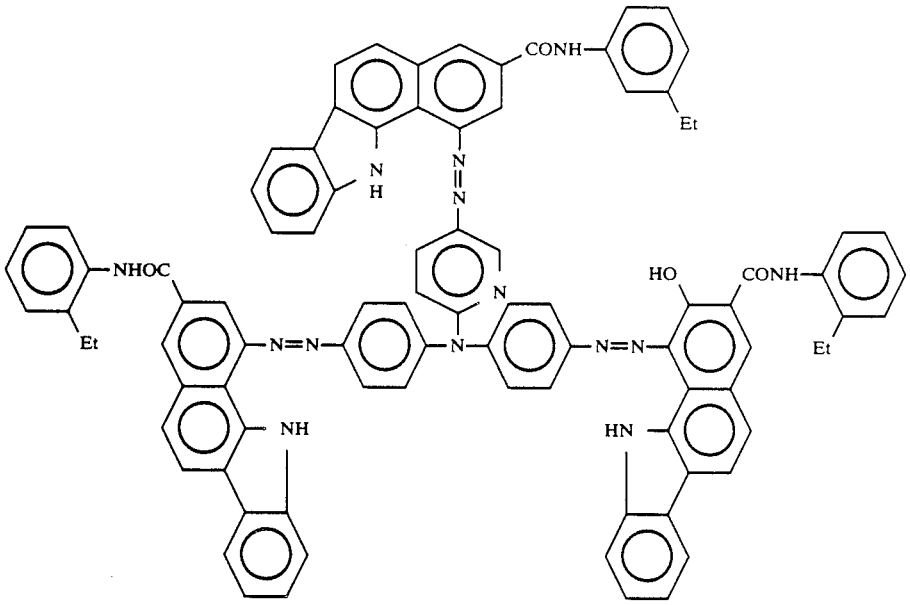

Preferred examples of the charge-transporting substance may include a triphenylamine-type compound represented by the following formula (4):

(4)

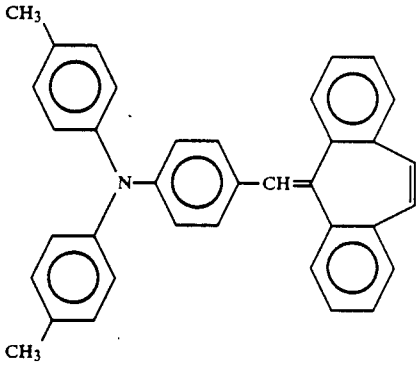

The image-forming method according to the present invention uses a magnetic toner having a specific particle size distribution such that it contains 12–60% by number of magnetic toner particles having a particle size of 5 microns or smaller, 1–33% by number of magnetic toner particles having a particle size of 8–12.7 microns, 2.0% by volume or less of magnetic toner particles having a particle size of 16 microns or larger, and has a volume-average particle size of 4–10 microns.

In the developing method according to the present invention, a toner-carrying member carrying such a magnetic toner on its surface is disposed opposite to a photosensitive member so as to provide a predetermined clearance therebetween at a developing zone (or developing region), and the magnetic toner is conveyed to the developing zone while the thickness of a toner layer formed on the toner-carrying member is regulated so that it is smaller than the above-mentioned clearance, whereby a latent image formed on the photosensitive member is developed. According to the above-mentioned developing method, digital and analog latent images as described above may faithfully be visualized thereby to provide a high-density image without fog.

The magnetic toner according to the present invention can faithfully reproduce thin lines in a latent image formed on a photosensitive member, and is excellent in reproduction of dot latent images such as a halftone dot and digital image, whereby it may provide images excellent in gradation and resolution characteristics. Further, the toner according to the present invention can retain a high image quality even in the case of successive copying or print-out, and can effect good development by using a smaller consumption thereof as compared with the conventional magnetic toner, even in the case of high-density images. As a result, the magnetic toner according to the present invention is excellent in economical characteristics and further has an advantage in miniaturization of the main body of a copying machine or printer.

The reason for the above-mentioned effects of the magnetic toner used in the present invention is not necessarily clear but may assumably be considered as follows.

The magnetic toner according to the present invention is characterized in that it contains 1214 60% by number of magnetic toner particles of 5 microns or below. Conventionally, it has been considered that magnetic toner particles of 5 microns or below are required to be positively reduced because the control of their charge amount is difficult, they impair the fluidity of the magnetic toner, cause toner scattering to contaminate the machine, and cause fog in the resultant image.

However, according to our investigation, it has been found that the magnetic toner particles of 5 microns or below are an essential component to form a high-quality image.

For example, we have conducted the following experiment.

Thus, there was formed on a photosensitive member a latent image wherein the surface potential on the photosensitive member was changed from a large developing potential contrast at which the latent image would easily be developed with a large number of toner particles, to a small developing potential contrast at which the latent image would be developed with only a small number of toner particles.

Such a latent image was developed with a magnetic toner having a particle size distribution ranging from 0.5 to 30 microns. Then, the toner particles attached to the photosensitive member were collected and the particle size distribution thereof was measured. As a result, it was found that there were many magnetic toner particles having a particle size of 8 microns or below, particularly 5 microns or below. Based on such finding, it was discovered that when magnetic toner particles of 5 microns or below were so controlled that they were smoothly supplied for the development of a latent image formed on a photosensitive member, there could be obtained an image truly excellent in reproducibility, and the toner particles were faithfully attached to the latent image without protruding therefrom.

The magnetic toner according to the present invention is further characterized in that it contains 1–33% by number of magnetic toner particles of 8–12.7 microns. Such a feature relates to the above-mentioned necessity for the presence of the toner particles of 5 microns or below.

As described above, the toner particles having a particle size of 5 microns or below have the ability to strictly cover a latent image and to faithfully reproduce it. On the other hand, in the latent image per se, the field intensity in its peripheral edge portion is higher than that in its central portion. Therefore, toner particles sometimes cover the inner portion of the latent image in a smaller amount than that in the edge portion thereof, whereby the image density in the inner portion sometimes appears to be lower. Particularly, the magnetic toner particles of 5 microns or below strongly have such a tendency. However, we have found that when 1–33% by number of toner particles of 8–12.7 microns are contained in a toner, not only the above-mentioned problem can be solved but also the resultant image can be made clearer.

According to our knowledge, the reason for such a phenomenon may be considered that the toner particles of 8–12.7 microns have suitably controlled charge amount in relation to those of 5 microns or below, and that these toner particles are supplied to the inner portion of the latent image having a lower field intensity than that of the edge portion thereby to compensate the decrease in cover-up of the toner particles to the inner portion as compared with that in the edge portion, and to form a uniform developed image. As a result, there may be provided a sharp image having a high-image density and excellent resolution and gradation characteristic.

In the magnetic toner according to the present invention, magnetic toner particles having a particle size of 16 microns or larger are contained in an amount of 2.0% by volume or below. The amount of these particles may preferably be as small as possible.

As described hereinabove, the magnetic toner according to the present invention has solved the problems encountered in the prior art from a viewpoint utterly different from that in the prior art, and can meet the recent severe demand for high image quality.

Hereinbelow, the present invention will be described in more detail.

In the present invention, the magnetic toner particles having a particle size of 5 microns or smaller may preferably be contained in an amount of 17–60% by number, more preferably 25–50% by number, particularly preferably 30–50% by number, based on the total number of particles. If the amount of magnetic toner particles of 5 microns or below is smaller than 17% by number, the amount of toner particles effective in enhancing image quality is insufficient. Particularly, as the toner particles are consumed in successive copying or print-out, the component of effective magnetic toner particles is decreased, and the balance in the particle size distribution of the magnetic toner shown by the present invention is deteriorated, whereby the image quality gradually decreases. On the other hand, the above-mentioned amount exceeds 60% by number, the magnetic toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a little low density is liable to occur.

In the magnetic toner according to the present invention, the amount of particles in the range of 8–12.7 microns is 1–33% by number, preferably 8–20% by number. If the above-mentioned amount is larger than 33% by number, not only the image quality deteriorates but also excess development (i.e., excess cover-up of toner particles) occurs, thereby to invite an increase in toner consumption. On the other hand, the above-mentioned amount is smaller than 1%, it is difficult to obtain a high image density.

In the magnetic toner according to the present invention, the amount of magnetic toner particles having a particle size of 16 microns or larger is 2.0% by volume or smaller, preferably 1.0% by volume or smaller, more preferably 0.5% by volume or smaller.

If the above amount is larger than 2.0% by volume, these particles can impair thin-line reproducibility. In addition, toner particles of 16 microns or larger are present as protrusions on the surface of the thin layer of toner particles formed on a photosensitive member by development, and they vary the transfer condition for the toner by irregulating the delicate contact state between the photosensitive member and a transfer paper (or a transfer-receiving paper) by the medium of the toner layer. As a result, an image with transfer failure can be provided.

In the present invention, the number-average particle size of the toner is 4–10 microns, preferably 4–9 microns. This value closely relates to the above-mentioned factors of the magnetic toner according to the present invention. If the number-average particle size is smaller than 4 microns, there tend to occur problems such that the amount of toner particles transferred to a transfer paper is insufficient and the image density is low, in the case of an image such as graphic image wherein the ratio of the image portion area to the whole area is high. The reason for such a phenomenon may be considered the same as in the above-mentioned case wherein the inner portion of a latent image provides a lower image density than that in the edge portion thereof. If the number-average particle size exceeds 10 microns, the resultant resolution is not good and there tends to occur a phenomenon such that the image quality is lowered in successive use even when it is good in the initial stage thereof.

Figure 4:
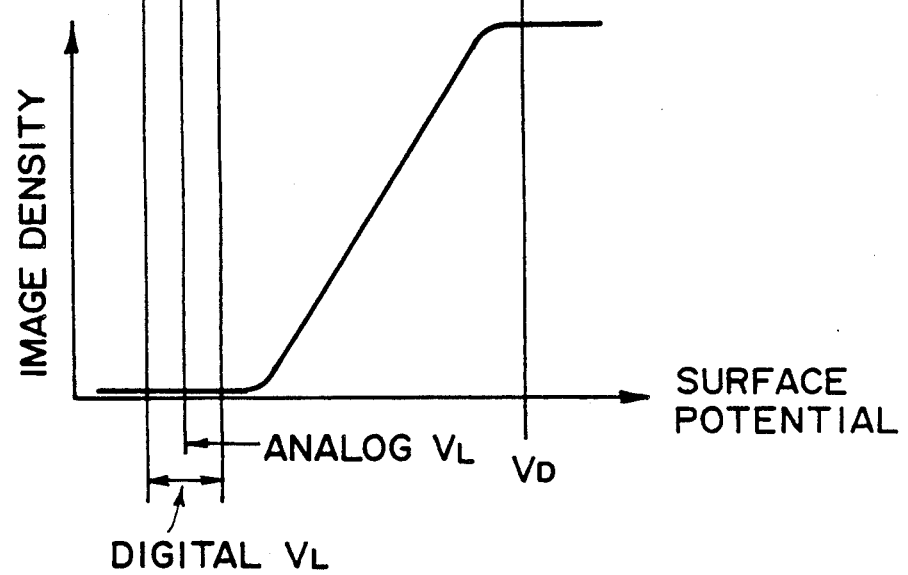

FIG. 4 is a schematic view showing the slope of a curve obtained by plotting image densities against surface potentials obtained in an embodiment of the developing method using the magnetic toner having a specific particle size distribution according to the present invention.

As apparent from FIG. 4, since the curve has an appropriate slope, an analog latent image may be faithfully developed corresponding to the potential thereof, thereby to obtain an image having a gradation characteristic with respect to halftone reproduction. Since the change from the $V_H$ (halftone potential) portion to $V_L$ portion is sharp, substantially no fog occurs even in a digital image. Further, since the change from the $V_H$ portion to the $V_D$ portion is also sharp, a sufficient image density may be provided in analog and digital latent images without causing variation in the image density.

The magnetic toner particles according to the present invention having a specific particle size distribution provide good and uniform cover-up for a latent image, as described hereinafter, and are attached to the latent image corresponding to the potential thereof. Accordingly, the change from $V_L$ to $V_H$ or that from $V_H$ to $V_D$ is sharp, and there can be obtained an image having a high image density without fog and having an excellent halftone reproducibility.

In the present invention, the magnetic toner used in a developing step may preferably be one having developing characteristics satisfying conditions as described in FIG. 4, with respect to the relationship between the potential of a latent image and the resultant image density.

More specifically, a developing means comprising the magnetic toner may preferably be one satisfying at least one of the following developing characteristics:

(i) The difference ($V_{L-H}$) between a latent image potential at which fog is observed with the naked eye and a latent image potential providing an image density of 0.2 is 100 V or smaller;

(ii) With respect to an image density range of 0.2 to 0.8, the amount of change in image density ($D_H$) per a latent image potential difference of 10 V is smaller than 0.11 (preferably, smaller than 0.10);

(iii) The difference ($V_{H-D}$) between a latent image potential providing an image density of 1.2 and a latent image potential providing an image density of 1.3 or higher (or the maximum image density of 1.2 or higher) is 100 V or smaller; and (iv) The difference ($V_{L-D}$) between a latent image potential at which fog is observed with the naked eye and a latent image potential providing an image density of 1.3 or higher (or the maximum image density of 1.2 or higher) is 400 V or smaller (more preferably 350 V or smaller, particularly preferably 300 V or smaller).

In the present invention, the latent image potential ($V_D$) of a black image portion may preferably be 550–750 V, more preferably 600–700 V, in terms of the absolute value thereof.

The particle size distribution of a toner is measured by means of a Coulter counter in the present invention, while it may be measured in various manners.

Coulter counter Model TA--II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis particle size distribution. From the results of the volume-basis distribution and number-basis distribution, parameters characterizing the magnetic toner of the present invention may be obtained.

The binder for use in constituting the toner according to the present invention, when applied to a hot pressure roller fixing apparatus using an oil applicator, may be a known binder resin for toner. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrileindene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

In a hot pressure roller fixing system using substantially no oil application, serious problems are provided by an offset phenomenon that a part of toner image on toner image-supporting member is transferred to a roller, and an intimate adhesion of a toner on the toner image-supporting member. As a toner fixable with less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking or caking are also more liable. Accordingly, when a hot roller fixing system using almost no oil application is adopted in the present invention, selection of a binder resin becomes more serious. A preferred binder resin may for example be a crosslinked styrene copolymer, or a crosslinked polyester. Examples of comonomers to form such a styrene copolymer may include one or more vinyl monomers selected from: monocarboxylic acids having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1, 3-butanediol diacrylate; divinyl compounds such as divinyl ether, divinyl sulfide and divinyl sulfone; and compounds having three or more vinyl groups. These compounds may be used singly or in mixture. The crosslinking agent may preferably be used in an amount of 0.01–5 wt. parts, per 100 wt. parts of the monomer.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters and paraffins.

In the magnetic toner of the present invention, it is preferred that a charge controller may be incorporated in the toner particles (internal addition), or may be mixed with the toner particles (external addition). By using the charge controller, it is possible to most suitably control the charge amount corresponding to a developing system to be used. Particularly, in the present invention, it is possible to further stabilize the balance between the particle size distribution and the charge.

Examples of the positive charge controller may include; nigrosine and its modification products modified by a fatty acid metal salt, quaternary ammonium salts, such as tributylbenzyl-ammonium-1-hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclohexyltin borate. These positive charge controllers may be used singly or as a mixture of two or more species. Among these, a nigrosine-type charge controller or a quaternary ammonium salt charge controller may particularly preferably be used.

As another type of positive charge controller, there may be used a homopolymer of a monomer having an amino group represented by the formula:

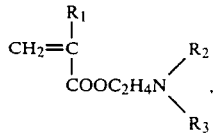

wherein $R_1$ represents H or $CH_3$; and $R_2$ and $R_3$ each represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller also has a function of (the entirety or a part of) a binder.

It is preferred that the above-mentioned charge controller (one not having the function of a binder resin) is used in the form of fine powder. In such a case, the number-average particle size thereof may preferably be 4 microns or smaller, more preferably 3 microns or smaller.

In the case of internal addition, such a charge controller may preferably be used in an amount of 0.1–20 wt. parts, more preferably 0.2–10 wt. parts, per 100 wt. parts of a binder resin.

An additive may be incorporated or mixed in the magnetic toner according to the present invention, as desired, by the internal addition or external addition. More specifically, as a colorant, known dyes or pigments may be used generally in an amount of 0.5–20 wt. parts per 100 wt. parts of a binder resin. Another optional additive to be used includes, for example, lubricants such as zinc stearate; abrasives such as cerium oxide and silicon carbide; flowability improvers such as colloidal silica and aluminum oxide; anti-caking agent; or conductivity-imparting agents such as carbon black and tin oxide.

In order to improve releasability in hot-roller fixing, it is also a preferred embodiment of the present invention to add to the magnetic toner a waxy material such as low-molecular weight polyethylene, low-molecular weight polypropylene, microcrystalline wax, carnauba wax, sasol wax or paraffin wax preferably in an amount of 0.5–5 wt. %.

The magnetic toner of the present invention contains a magnetic material which may also function as a colorant. The magnetic material to be contained in the magnetic toner may be one or a mixture of: iron oxides such as magnetite, γ-iron oxide, ferrite and ferrite containing excess iron; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These ferromagnetic materials may preferably be in the form of particles having an average particle size of the order of 0.1–1 micron, preferably 0.1–0.5 microns and be used in the toner in an amount of about 60–120 wt. parts, particularly 65–110 wt. parts, per 100 wt. parts of a resin component.

The magnetic toner according to the present invention may preferably have a triboelectric charging characteristic such that it provides an absolute value of triboelectric charge (amount) of 5–20 μc/g, more preferably 7–15 μc/g. The triboelectric charging characteristic of the magnetic toner may be determined in the following manner.

10 g of magnetic toner particles which have been left to stand overnight in an environment of 25° C. and relative humidity of 50 to 60% RH, and 90 g of carrier iron powder not coated with a resin having particle sizes of 200 mesh-pass and 300 mesh-on, i.e., having a mode particle size in the range of 200 to 300 mesh (Tyler) (e.g., EFV 200/300, produced by Nippon Teppun K.K.) are mixed thoroughly in an aluminum pot having a volume of about 200 cc in the same environment as mentioned above (by hand shaking the pot vertically for about 50 times), and the triboelectric charge of the magnetic toner particles is measured according to the conventional blow-off method by means of an aluminum cell having a 400 mesh-screen.

The magnetic toner for developing electrostatic images according to the present invention may be produced by sufficiently mixing magnetic powder with a vinyl on non-vinyl thermoplastic resin such as those enumerated hereinbefore, and optionally, a pigment or dye as colorant, a charge controller, another additive, etc., by means of a mixer such as a ball mill, etc.; then melting and kneading the mixture by hot kneading means such as hot rollers, a kneader and an extruder to disperse or dissolve the pigment or dye, and optional additives, if any, in the melted resin; cooling and crushing the mixture; and subjecting the powder product to precise classification to form magnetic toner according to the present invention.

The magnetic toner according to the present invention may also be obtained in the following manner: one wherein a material constituting the toner is dispersed in a solution of a binder resin and the resultant mixture is spray-dried to obtain the toner; one wherein a predetermined material is mixed with a monomer constituting a binder resin to obtain an emulsion or dispersion, which is then subjected to polymerization to obtain the toner (i.e., polymerization method); one wherein a predetermined material is incorporated in the both of, or either one of, a core material and a shell material constituting an encapsulated toner.

In the present invention, the true density of the magnetic toner may preferably be 1.45–1.70 g/cm$^3$, more preferably 1.50–1.65 g/cm$^3$. When the true density is in such a range, the magnetic toner according to the present invention having a specific particle size distribution functions most effectively in view of high image quality and stability in successive use.

If the true density of the magnetic toner particles is smaller than 1.45 b/cm$^3$, the weight of the magnetic toner particle per se is too light and there tend to occur reversal fog, and deformation of thin lines, scattering and deterioration in resolution because an excess of toner particles are attached to the latent image. On the other hand, the true density of the magnetic toner is larger than 1.70 g/cm$^3$, there occurs an image wherein the image density is low, thin lines are interrupted, and the sharpness is lacking. Further, because the magnetic force becomes relatively strong in such a case, ears of the toner particles are liable to be lengthened or converted into a branched form. As a result, the image quality is disturbed in the development of a latent image, whereby a coarse image is liable to occur.

In the present invention, the true density of the magnetic toner is measured in the following manner which can simply provide an accurate value in the measurement of fine powder, while the true density can be measured in some manners.

There are provided a cylinder of stainless steel having an inside diameter of 10 mm and a length of about 5 cm, and a disk (A) having an outside diameter of about 10 mm and a height of about 5 mm, and a piston (B) having an outside diameter of about 10 mm and a length of about 8 cm, which are capable of being closely inserted into the cylinder.

In the measurement, the disk (A) is first disposed on the bottom of the cylinder and about 1 g of a sample to be measured is charged in the cylinder, and the piston (B) is gently pushed into the cylinder. Then, a force of 400 Kg/cm$^2$ is applied to the piston by means of a hydraulic press, the sample is pressed for 5 min, and is then taken out. The weight (Wg) of thus pressed sample is measured and the diameter (D cm) and the height (L cm) thereof are measured by means of a micrometer. Based on such a measurement, the true density may be calculated according to the following formula:

$$\text{True density } (g/cm^3) = W/(\pi \times (D/2)^2 \times L)$$

In order to obtain better developing characteristics, the magnetic toner of the present invention may preferably have the following magnetic characteristics: a residual magnetization $\sigma_r$ of 1–5 emu/g, more preferably 2–4.5 emu/g; a saturation magnetization $\sigma_s$ of 20–40 emu/g; and a coercive force Hc of 40–100 Öe. These magnetic characteristics may be measured under a magnetic field for measurement of 1,000 Öe.

It is preferred that silica fine powder is added to the magnetic toner according to the present invention by internal addition or external addition, but the external addition is particularly preferred.

In the magnetic toner of the present invention having the above-mentioned particle size distribution characteristic, the specific surface area thereof becomes larger than that in the conventional toner. In a case where the magnetic toner particles are caused to contact the surface of a cylindrical electroconductive non-magnetic sleeve containing a magnetic field-generating means therein in order to triboelectrically charge them, the frequency of the contact between the toner particle surface and the sleeve is increased as compared with that in the conventional magnetic toner, whereby the abrasion of the toner particle is liable to occur. However, when the magnetic toner of the present invention is combined with the silica fine powder, the silica fine powder is disposed between the toner particles and the sleeve surface, whereby the abrasion of the toner particles is remarkably reduced.

Thus, the life of the magnetic toner and the sleeve may be lengthened and the chargeability may stably be retained. As a result, there can be provided a developer comprising a magnetic toner showing excellent characteristics in long-time use.

The silica fine powder may be those produced through the dry process and the wet process. The silica fine powder produced through the dry process is preferred in view of the anti-filming characteristic and durability thereof.

The dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | MOX 170 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silica powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2\ nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica powder to be used herein may be anhydrous silicon dioxide (silica), and also a silicate such as aluminum silicate, sodium silicate, potassium silicate, magnesium silicate and zinc silicate.

Commercially available fine silica powders formed by the wet process include those sold under the trade names as shown below:

Carplex (available from Shionogi Seiyaku K.K.)
Nipsil ( Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Siloid (Fuji Devison Kagaku K.K.)
Hi-Sil (Pittsuburgh Plate Glass Co.)
Durosil, Ultrasil (Fulstoff-Gesellshaft Marquart)
Manosil (Hardman and Holden)
Hoesch (Chemische Fabrik Hoesch K-G)
Sil-Stone (Stoner Rubber Co.)
Nalco (Nalco Chem. Co.)
Quso (Philadilphia Quartz Co.)
Imsil (Illinois Minerals Co.)
Calcium Silikat (Chemische Fabrik Hoesch, K-G)
Calsil (Fullstoff-Gesellschaft Marquart)
Fortafil (Imperial Chemical Industries)
Microcal (Joseph Crosfield & Sons. Ltd.)
Vulkasil (Farbenfabriken Bayer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.)

Among the above-mentioned silica powders, those having a specific surface area as measured by the BET method with nitrogen adsorption of 30 $m^2/g$ or more, particularly 50–400 $m^2/g$, provides a good result.

In the present invention, the silica fine powder may preferably be used in an amount of 0.01–8 wt. parts, more preferably 0.1–5 wt. parts, with respect to 100 wt. parts of the magnetic toner.

In the case where the magnetic toner of the present invention is used as a positively chargeable magnetic toner, it is preferred to use positively chargeable fine silica powder rather than negatively chargeable fine silica powder, in order to retain the stability in chargeability.

In order to obtain positively chargeable silica fine powder, the above-mentioned untreated silica powder may be treated with a silicone oil having an organic groups containing at least one nitrogen atom in its side chain, a nitrogen-containing silane coupling agent, or both of these.

In the present invention, "positively chargeable silica" means one having a positive triboelectric charge with respect to iron powder carrier when measured by the blow-off method.

The silicone oil having a nitrogen atom in its side chain to be used in the treatment of silica fine powder may be a silicone oil having at least the following partial structure:

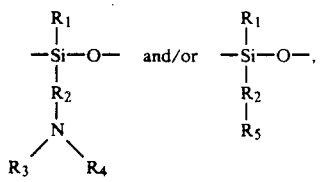

wherein $R_1$ denotes hydrogen, alkyl, aryl or alkoxyl; $R_2$ denotes alkylene or phenylene; $R_3$ and $R_4$ denotes hydrogen, alkyl, or aryl; and $R_5$ denotes a nitrogen-containing heterocyclic group.

The above alkyl, aryl, alkylene and phenylene group can contain an organic group having a nitrogen atom, or have a substituent such as halogen within an extent not impairing chargeability. The above-mentioned silicone oil may preferably be used in an amount of 0.1–100 wt. parts, per 100 wt. parts of the silica.

The nitrogen-containing silane coupling agent used in the present invention generally has a structure represented by the following formula:

$$R_mSiY_n,$$

wherein R is an alkoxy group or a halogen atom; Y is an amino group or an organic group having at least one amino group or nitrogen atom; and m and n are positive integers of 1–3 satisfying the relationship of $m+n=4$.

The organic group having at least one nitrogen group may for example be an amino group having an organic group as a substituent, a nitrogen-containing heterocyclic group, or a group having a nitrogen-containing heterocyclic group. The nitrogen-containing heterocyclic group may be unsaturated or saturated and may respectively be known ones. Examples of the unsaturated heterocyclic ring structure providing the nitrogen-containing heterocyclic group may include the following:

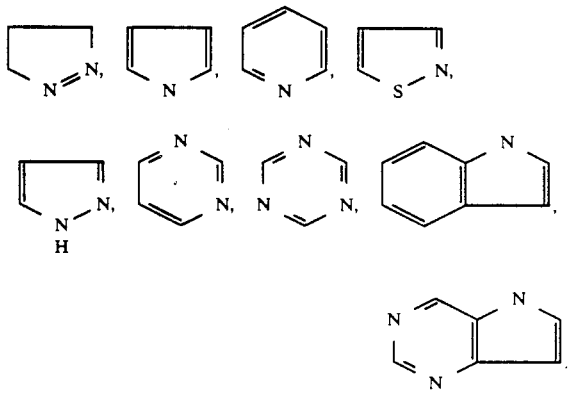

Examples of the saturated heterocyclic ring structure include the following:

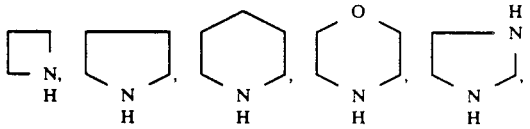

-continued

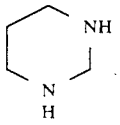

The heterocyclic groups used in the present invention may preferably be those of five-membered or six-membered rings in consideration of stability.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrtimethoxysilane,
dibutylaminopropyltrimethoxysilane,
monobutylaminopropyltrimethoxysilane,
dioctylaminopropyltrimethoxysilane,
dibutylaminopropyldimethoxysilane,
dibutylaminopropylmonomethoxysilane,
dimethylaminophenyltriethoxysilane,
trimethoxysilyl-γ-propylphenylamine, and
trimethoxysilyl-γ-propylbenzylamine.
Further, examples of the nitrogen-containing heterocyclic compounds represented by the above structural formulas include:
trimethoxysilyl-γ-propylpiperidine,
trimethoxysilyl-γ-propylmorpholine, and
trimethoxysilyl-γ-propylimidazole.
The above-mentioned nitrogen-containing silane coupling may preferably be used in an amount of 0.1–100 wt. parts per 100 wt. parts of the silica.

The thus treated positively chargeable silica powder shows an effect when added in an amount of 0.01–8 wt. parts and more preferably may be used in an amount of 0.1–5 wt. parts, respectively with respect to 100 wt. parts of the positively chargeable magnetic toner to show a positive chargeability with excellent stability. As a preferred mode of addition, the treated silica powder in an amount of 0.1–3 wt. parts with respect to 100 wt. parts of the positively chargeable magnetic toner should preferably be in the form of being attached to the surface of the toner particles. The above-mentioned untreated silica fine powder may be used in the same amount as mentioned above.

The silica fine powder used in the present invention may be treated as desired with another silane coupling agent or with an organic silicon compound for the purpose of enhancing hydrophobicity. Examples of such treating agents include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing each one hydroxyl group bonded to Si at the terminal units. These may be used alone or as a mixture of two or more compounds. The above-mentioned treating agent may preferably be used in an amount of 0.1–100 wt. % per 100 wt. parts of the silica.

In the present invention, it is preferred to add fine powder of a fluorine-containing polymer by internal addition or external addition. Examples thereof may include polytetrafluoroethylene, polyvinylidene fluoride, or tetrafluoroethylenevinylidene fluoride copolymer. Among these, polyvinylidene fluoride fine powder is particularly preferred in view of fluidity and abrasiveness. Such powder of a fluorine-containing polymer may preferably be added to the toner in an amount of 0.01–2.0 wt. %, particularly 0.02–1.0 wt. %.

In a magnetic toner wherein the silica fine powder and the above-mentioned fluorine-containing fine powder are combined, while the reason is not necessarily clear, there occurs a phenomenon such that the state of the presence of the silica attached to the toner particle is stabilized and, for example, the attached silica is prevented from separating from the toner particle so that the effect thereof on toner abrasion and sleeve contamination is prevented from decreasing, and the stability in chargeability can further be enhanced.

Figure 5:
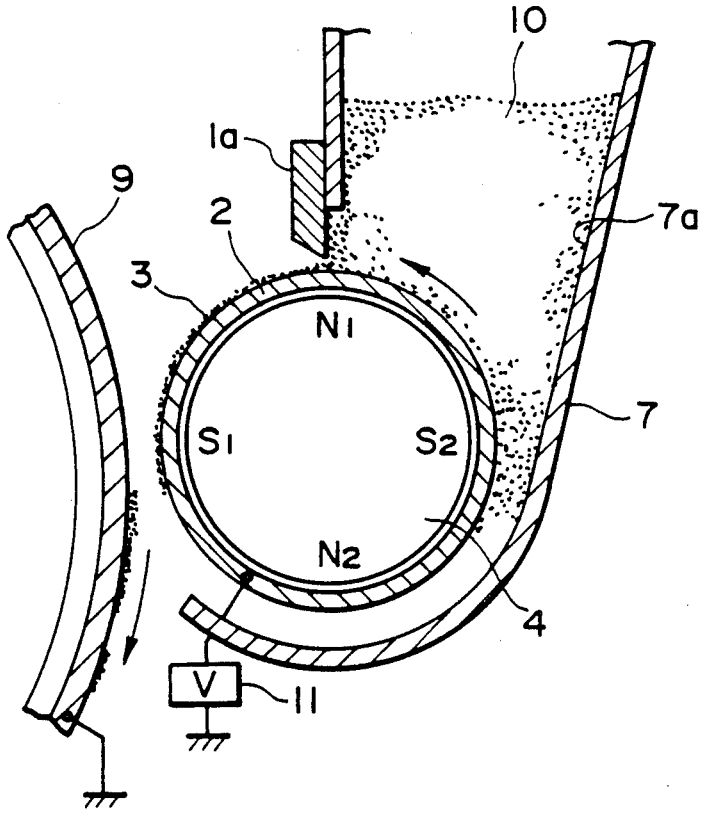
FIG. 5 is a schematic sectional view showing an embodiment of the developing device according to the present invention.

FIG. 5 shows an embodiment of the apparatus for practicing the developing step according to the present invention.

The magnetic toner according to the present invention may preferably be applied to a developing method wherein a latent image is developed while toner particles are caused to fly from a toner-carrying member such as a cylindrical sleeve to a latent image-carrying member such as a photosensitive member.

The magnetic toner is supplied with triboelectric charge mainly due to the contact thereof with the sleeve surface and applied onto the sleeve surface in a thin layer form. The thin layer of the magnetic toner is formed so that the thickness thereof is smaller than the clearance between the photosensitive member and the sleeve in a developing region. In the development of a latent image formed on the photosensitive member, it is preferred to cause the magnetic toner particles having triboelectric charge to fly from the sleeve to the photosensitive member, while applying an alternating electric field between the photosensitive member and the sleeve.

Examples of the alternating electric field may include a pulse electric field, or an electric field based on an AC bias or a superposition of AC and DC biases.

In the developing device as shown in FIG. 5, for example, the non-magnetic sleeve 2 as a toner-carrying member is a stainless steel sleeve (SUS304) having a diameter of 50 mm; the magnet 4 contained in the sleeve 2 is one having magnetic poles of $N_1=850$ gauss, $N_2=500$ gauss, $S_1=650$ gauss and $S_2=500$ gauss; the blade 1*a* comprises iron as a magnetic material; the clearance between the blade 1*a* and the sleeve 2 is 250 microns, the toner 10 comprises the magnetic toner according to the present invention; the bias voltage supply 11 is one providing a superposition of AC and DC voltage wherein Vpp=1200 V, f=800 Hz, and DC=+100 V. The minimum clearance between the sleeve 2 and the latent image-bearing member 9 may for example be 300 microns.

In the image-forming method according to the present invention, when the toner-carrying member for carrying a magnetic toner on its surface comprises one of which surface has been subjected to a sandblasting treatment by using irregularly-shaped particles so as to provide an uneven rough surface having a specific unevenness state, the toner can be constantly applied onto the toner-carrying member surface uniformly and evenly for a long period so as to provide a good toner coating state. An example of the toner-carrying member suitable for such a purpose is one having a surface such that the entire surface has innumerable fine cuts or protrusions formed in random directions.

However, the developing apparatus containing the toner-carrying member having the above-mentioned specific surface condition does not always provide good results, when combined with a certain kind of magnetic toner. For example, when a magnetic toner having a specific property is used, the toner or component constituting it adheres to the toner-carrying member surface to contaminate it, whereby a decrease in image density can occur in the initial image. The reason for such a phenomenon may be considered that the toner component adheres to the slope of convexities and the concavities of the toner-carrying member surface and charging failure in the magnetic toner particles occurs, whereby the amount of charge in the resultant toner layer is decreased.

In such a case, in order to prevent or suppress the contamination of a toner-carrying member, the surface thereof may preferably be made smoother. According to our investigation, in the toner-carrying member for a magnetic toner used in the developing method according to the present invention, when the surface thereof have a specific unevenness comprising a plurality of spherical impressions or indentations, a toner component is less liable to adhere to the surface, the contamination thereof is prevented or suppressed for a long period, and the resultant surface of the toner-carrying member has an excellent property of forming a uniform magnetic toner coating thereon.

The toner-carrying member showing such a surface form is also excellent in the triboelectric charge-imparting ability, and it can cause the magnetic toner according to the present invention to sufficiently exhibit its triboelectric charge-imparting ability, whereby the chargeability is stabilized. Accordingly, when the above-mentioned toner-carrying member is used, the potential of an electrostatic latent image is more easily followed, and there is provided a close-grained or minute image excellent in gradation characteristic with respect to half-tone. Further, the potential-image density curve is changed more sharply at the $V_L$ portion, whereby fog is prevented more effectively.

Hereinbelow, the toner-carrying member is referred to as a "sleeve".

In order to obtain a sleeve with a surface having unevenness comprising a plurality of spherical impressions, there may be used a blasting treatment using particles with a regular shape. Examples of the particles with a regular shape may include; rigid spheres with a specific particle size comprising a metal such as stainless steel, aluminum, steel, nickel, and brass; and rigid particles comprising ceramic, plastic, glass beads, etc. When a sleeve surface is subjected to a blasting treatment using particles of a regular shape having a predetermined particle size, plural spherical impressions or indentations having substantially the same diameter R may be formed.

The plural spherical impressions formed on the sleeve surface may preferably have a diameter R of 20–250 microns, more preferably 30–200 microns. If the diameter R is smaller than 20 microns, contamination due to a component constituting a magnetic toner tends to increase. If the diameter R is larger than 250 microns, the uniformity of a toner coating layer formed on the sleeve tends to decrease. Accordingly, the regularly-shaped particles used in the blasting treatment of the sleeve surface may preferably have a diameter of 20–250 microns.

In the present invention, the pitch P of the unevenness and surface roughness d of a sleeve surface may be measured by means of a micro-surface roughness meter (trade name; Surfcorder SE-3F, mfd. by Kosaka Laboratory Ltd.), and the surface roughness d is represented by an average of ten measured values of surface roughness ($R_Z$) according to JIS B 0601.

Figure 6:
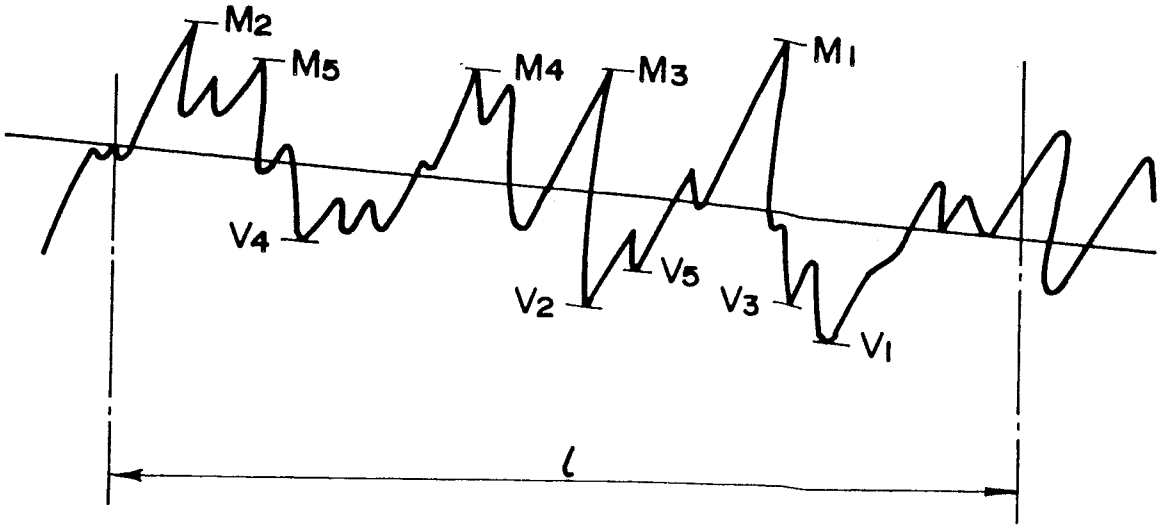
FIG. 6 is a schematic view for illustrating the definitions of surface roughness and pitch.

FIG. 6 is a schematic view for illustrating the above-mentioned pitch P and surface roughness d.

More specifically, FIG. 6 shows a portion with a reference length of l extracted from a sectional curve, and an average line. $M_1$ to $M_5$ denote crests (or peaks) of the sectional curve and $V_1$ to $V_5$ denote bottoms of the sectional curve. Referring to FIG. 6, the roughness average of ten measurements (or average of ten measured values of surface roughness) is expressed by the distance between specific two straight lines parallel to the average line in terms of micrometers, wherein one is a line passing through the third highest crest and the other is a line passing through the third deepest bottom. In FIG. 6, the reference length (l) is 0.25 mm.

On the other hand, the pitch P is determined in the following manner.

Referring to FIG. 6, in the sectional curve having the reference length of 0.25 mm, the number of crests having a height of 0.1 micron or larger counted from the bottoms on both sides is counted. The pitch P is determined according to the following formula:

P=250 (microns)/(number of the crests contained in the reference length of 250 microns)

The pitch P of the unevenness of a sleeve surface may preferably be 2–100 microns, more preferably 10–80 microns. If the pitch P is smaller than 2 microns, contamination due to a component constituting a magnetic toner tends to increase. If the pitch P is larger than 100 microns, the uniformity of a toner coating layer formed on the sleeve tends to decrease.

The above-mentioned surface roughness d of a sleeve surface may preferably be 0.1–5 microns, more preferably 0.5–4 microns. In a developing system wherein an alternating voltage is applied between the sleeve and a latent image-bearing member so that a magnetic toner is caused to fly from the sleeve side to the latent image-bearing surface, if the d is larger than 5 microns, an electric field is concentrated on the uneven portion, whereby the resultant image tends to be disturbed. If the d is smaller than 0.1 microns, the uniformity of a toner coating layer formed on the sleeve tends to decrease.

Figure 7:
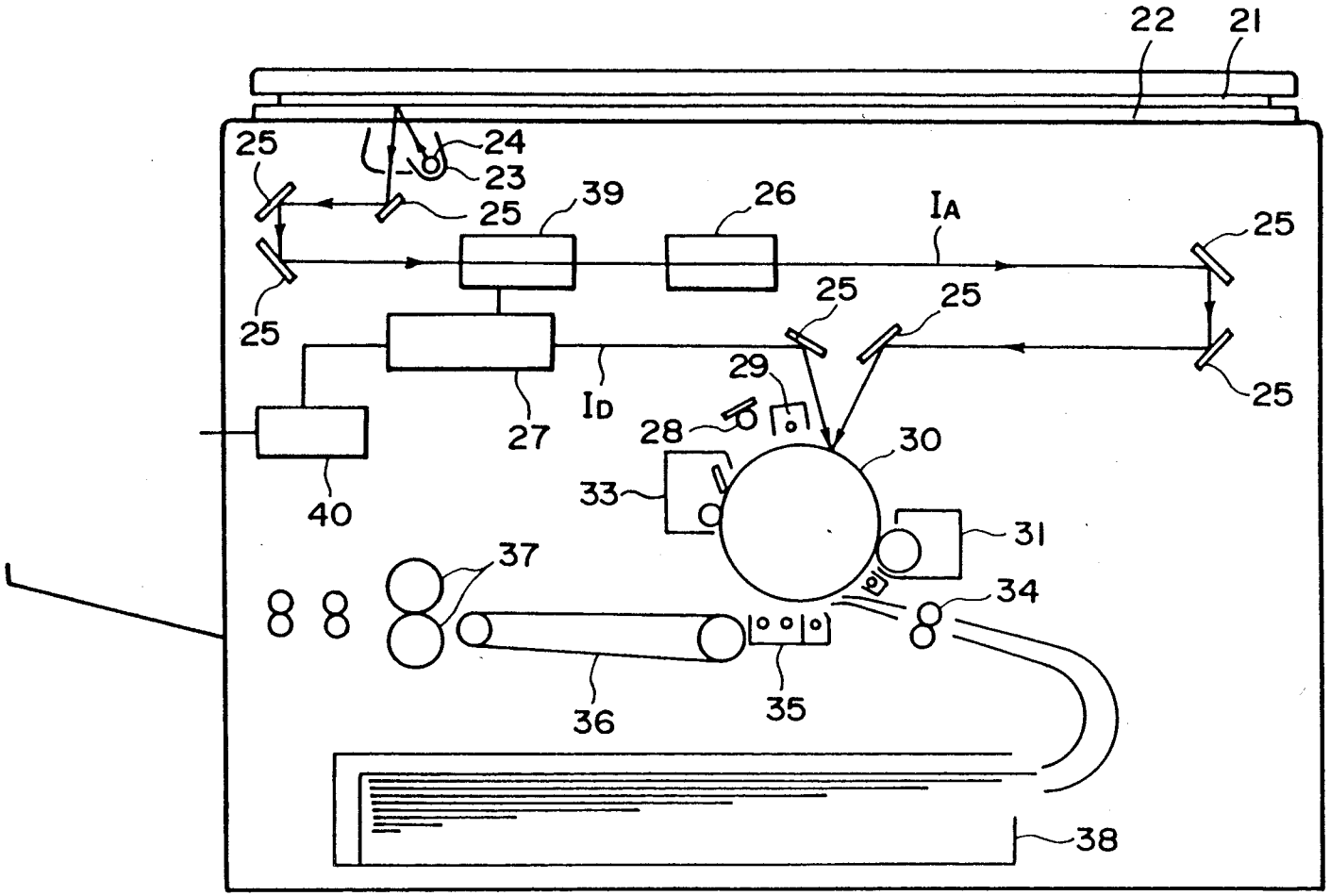
FIG. 7 is a schematic sectional view showing an embodiment of the image-forming apparatus according to the present invention.

FIG. 7 shows an embodiment of the apparatus for practicing the image forming method according to the present invention.

First, a step of forming an electrostatic latent image on a photosensitive member 30 with reference to FIG. 7. After the photosensitive member 30 is charged by means of a primary charger 29, the reflection light $I_A$ obtained by illuminating an original 21 with a halogen lamp (or fluorescent lamp) 24 is focused on the photosensitive member 30 by means of a lens array 26 and a reflection mirrors 25, thereby to form thereon an analog latent image. On the other hand, an electric signal output from a keyboard or an external device, or an image signal obtained from an original is processed by means of an image processing unit 39 and the resultant electric signal is input to a laser scanner 27. The resultant laser light $I_D$ is supplied to the photosensitive member 30, thereby to form a digital latent image.

The thus formed latent image is simultaneously developed with a developing device 31 according to the above-mentioned developing step to form a toner image on the photosensitive member 30. The toner image is then transferred to a transfer material 38 by means of a transfer-separation charger 35, and thereafter the transfer material is separated from the photosensitive member 30. The toner image transferred to the transfer material 38 is fixed thereon by means of a fixing device 37 to obtain a fixed image on the transfer material 38.

After the transfer of the toner image, the residual toner remaining on the photosensitive member 30 is removed by means of a cleaner 33, the photosensitive member 30 is then discharged by a preexposure lamp 28, and is provided for repetitive use.

Hereinbelow, the present invention will be described in further detail with reference to Examples. In the following formulations, "parts" are parts by weight.

EXAMPLE 1

An image forming apparatus as shown in FIG. 7 was used for image formation.

First, a photosensitive drum 30 was prepared in the following manner.

100 parts of electroconductive powder (particle size=about 0.4 micron) obtained by coating titanium oxide particles with tin oxide containing 10% of antimony oxide (tin oxide content=75% based on the titanium oxide) was added to a solution comprising 100 parts of resol-type phenolic resin, 30 parts of methanol and 100 parts of methyl cellosolve and was sufficiently dispersed therein. The resultant coating liquid was applied onto a substrate of an aluminum cylinder having a diameter of 80 mm and a length of 360 mm by dipping, and was subjected to curing under heating at 140° C. for 30 min., thereby to form a 20 micron-thick electroconductive undercoat layer.

Separately, 1 part of quaternary (6-66-610-12) nylon having a weight-average molecular weight (Mw) of about $1.4\times10^5$ and 3 parts of 8-nylon resin (Mw=about $1.0\times10^5$, methoxymethylated 6-nylon, methoxy degree=about 30%) were dissolved in 50 parts of methanol and 40 parts of butanol to obtain a coating liquid, which was then applied onto the undercoat layer by dipping, thereby to form a 0.5 micron-thick intermediate layer.

Further, 2.5 parts of a bisazo-type pigment represented by the following formula (1), 1.0 part of a bisazo-type pigment represented by the formula (5):

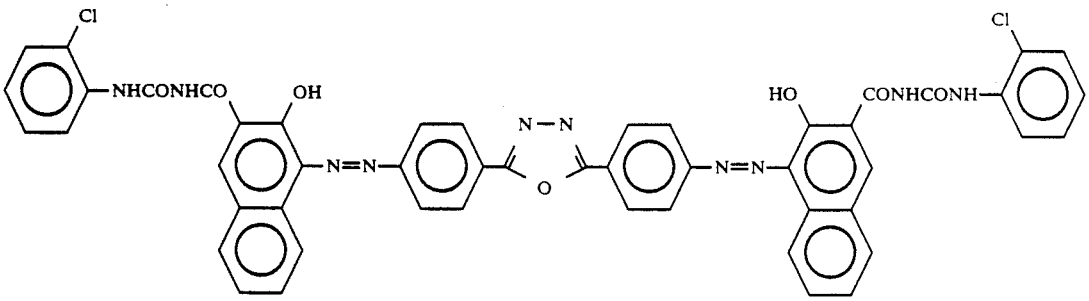

(1)

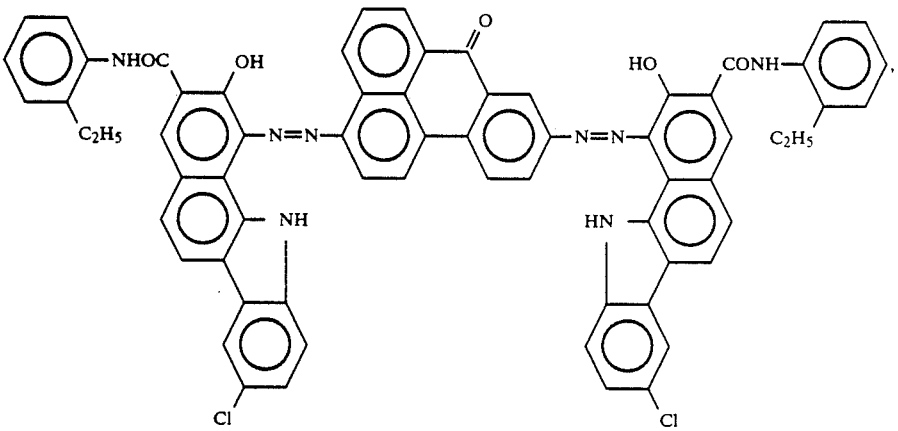

(5)

and 2 parts of a polyvinyl benzal resin represented by the following formula (number-average molecular weight (Mn)=85,000, benzal degree=80):

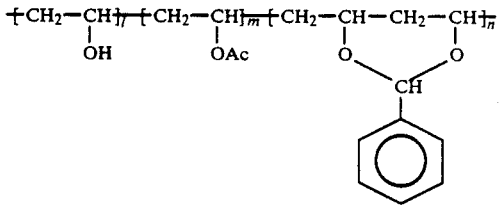

were dispersed in 100 parts of cyclohexanone by means of a sand mill using glass beads with a diameter of 1 mm for 2 hours.

To the resultant dispersion, 40–80 parts of tetrahydrofuran (THF) and 40–80 parts of methyl ethyl ketone were appropriately added and then the resultant coating liquid was applied onto the intermediate layer and dried at 80° C. for 10 min., thereby to form a charge generation layer having a coating weight (or coating amount) of 250 mg/m$^2$ with respect to the binder and the charge-generating substance.

Separately, 10 parts of a bisphenol Z-type polycarbonate resin (Mn=22,000) and 5 parts of polytetrafluoroethylene powder (average particle size=about 0.3 micron) as fluorine-containing resin powder were dispersed in 40 parts of monochlorobenzene and 15 parts of THF by means of a ball mill of stainless steel for 50 hours. In the resultant dispersion, 10 parts of a stilbene compound represented the following formula (6):

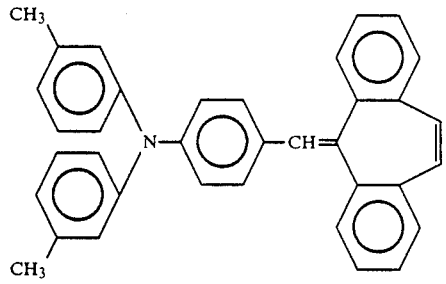

(6)

was dissolved. The resultant coating liquid was applied onto the above-mentioned charge generation layer and dried at 120° C. for 1 hour by using hot air to form a 25 micron-thick charge transport layer, whereby a photosensitive member 30 was prepared.

The thus obtained photosensitive member 30 was assembled in an image forming apparatus as shown in FIG. 7.

Figure 8:
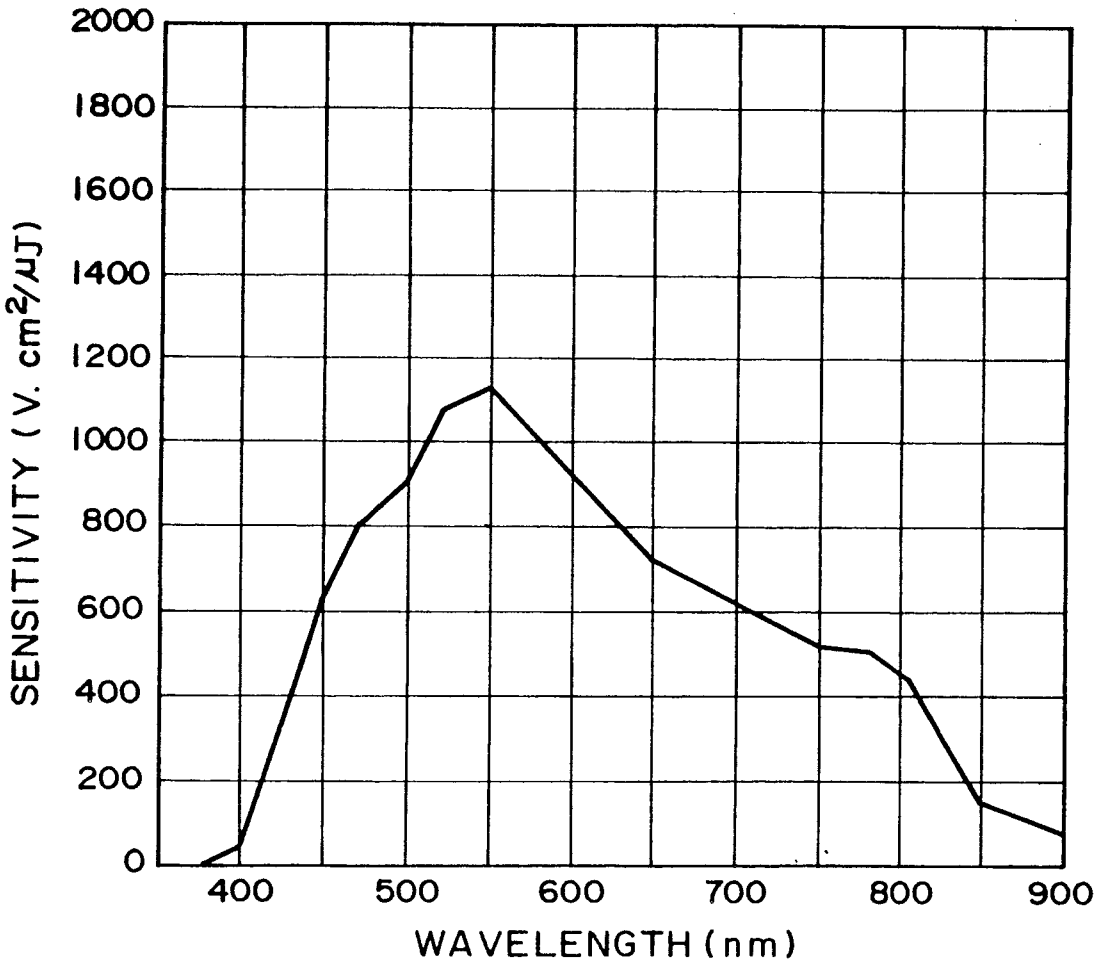
FIG. 8 is a graph showing the spectral sensitivity of an embodiment of the photosensitive drum according to the present invention.

The above-mentioned photosensitive member showed a spectral sensitivity as shown in FIG. 8, according to a measurement using a measurement device (Paper. Analyzer SP-428, mfd. by Kawaguchi Denki Seisakusho). Referring to FIG. 7, the laser scanner 27 was one using ia semiconductor laser of 780 nm and was controlled so as to provide a spot diameter of 100 microns and a scanning line density of 254 DPI (dot per inch) on the photosensitive member 30.

In this instance, the photosensitive member 30 was charged by using a primary charger 29 so as to provide a dark part potential ($V_D$) of −700 V, and the light quantity of the reflection light $I_A$ based on the illumination with a halogen lamp was set to 1.5 lux.sec so as to provide a light part potential ($V_L$) of −200 V. The laser output for the formation of a digital latent image was set to 1.2 $\mu J/cm^2$ so as to provide a light part potential ($V_L$) of −200 V on average. According to the above-mentioned step, analog and digital latent images were formed on the photosensitive member 30.

Next, the developing conditions used in this instance are explained with reference to FIG. 5.

Referring to FIG. 5, a magnetic toner 10 contained in a developer chamber 7 was applied in a thin layer form onto the surface of a cylindrical sleeve 2 of stainless steel by the medium of a magnetic blade 1*a*. The clearance between the sleeve 2 and the blade 1*a* was set to about 250 microns so as to form about a 90 micron-thick toner layer. The sleeve 2 contained a fixed magnet 4 as a magnetic field-generating means. The fixed magnet 4 produced a magnetic field of 1000 gauss in the neighborhood of the sleeve surface in the developing region where the sleeve 2 was disposed near to the photosensitive drum 9 comprising an organic photoconductor layer carrying a negative latent image. The minimum space between the sleeve 2 and the photosensitive drum 9 rotating in the direction shown by an arrow was set to about 300 microns.

In the development, a bias obtained by superposing an AC bias of 2000 Hz/1350 Vpp and a DC bias of 250 V was applied between the photosensitive drum 9 and the sleeve 2.

The sleeve as a toner-carrying member was one obtained by subjecting the surface of a stainless steel sleeve (SUS 304) to a blasting treatment for 2 min. In the blasting treatment, Carborundum #300 (mfd. by Fuji Seisakusho) was used as irregularly-shaped particles, the diameter of a blowing nozzle was 7 mm, the distance between the nozzle and the sleeve surface was 100 mm, and the air pressure was 4 $kg/cm^2$.

By using the above-mentioned developing device, the above-mentioned latent images were developed and the resultant toner image formed on the photosensitive member 30 was transferred to a transfer material 38, which was then subjected to a fixing treatment, whereby an image was obtained.

Next, there is described a method of evaluating an image used in the present invention.

With respect to the analog image, thin-line reproducibility was measured in the following manner.

An original image comprising thin lines accurately having a width of 100 microns was copied under a suitable copying condition, i.e., a condition such that a circular original image having a diameter of 5 mm and an image density of 0.3 (halftone) was copied to provide a copy image having an image density of 0.3–0.5, thereby to obtain a copy image as a sample for measurement. An enlarged monitor image of the sample was formed by means of a particle analyzer (Luzex 450, mfd. by Nihon Regulator Co. Ltd.) as a measurement device, and the line width was measured by means of an indicator. Because the thin line image comprising toner particles had unevenness in the width direction, the measurement points for the line width were determined so that they corresponded to the average line width, i.e., the average of the maximum and minimum line widths. Based on such measurement, the value (%) of the thin-line reproducibility was calculated according to the following formula:

$$\frac{\text{Line width of copy image obtained by the measurement}}{\text{Line width of the original (100 microns)}} \times 100$$

Further, the resolution was measured in the following manner.

There were formed ten species of original images comprising a pattern of five thin lines which having equal line width and being disposed at equal intervals equal to the line width. In these ten species of original images, thin lines were respectively drawn so that they provide densities of 2.8, 3.2, 3.6, 4.0, 4.5, 5.0, 5.6, 6.3, 7.1, and 8.0 lines per 1 mm. These ten species of original images were copied under the above-mentioned suitable copying conditions to form copy images which were then observed by means of a magnifying glass. The value of the resolution was so determined that it corresponded the maximum number of tin lines (lines/mm) of an image wherein all the thin lines were clearly separated from each other. As the above-mentioned number is larger, it indicates a high resolution.

With respect to the digital image, line-expression characteristic and resolution were determined in the following manner.

A latent image was formed on a photosensitive member by using laser light so as to provide five lines (100 microns) in the form of one dot—one space. The resolution was evaluated by using the resolving power of the resultant line image of five lines/mm. Further, the line-expression characteristic was evaluated by using a copy image comprising four lines (100 microns) in the form of one dot—two spaces according to the following formula:

(Average line width of copy image obtained by the measurement)/(100 microns)×100, wherein the average line width was determined in the same manner as in the analog image.

Further, the dot-expression characteristic was determined in the following manner. Four species of latent images were formed on a photosensitive by using laser light so as to provide a checked image wherein each portion comprises 1 dot, 2 dots, 3 dots and 4 dots, respectively. In the measurement, the resultant copy image was observed with a magnifying glass (magnification: 30), and the value of the dot-expression characteristic was so determined that it corresponded to the maximum number of dots of a checked image wherein the checked portions were clearly observed. As the above-mentioned number is larger, it indicates a better dot-expression characteristic.

In an image formation test, digital and analog images were simultaneously obtained in the following manner. By using an original containing a solid black portion, and a digital latent image was formed in a portion of a photosensitive member corresponding to the solid black portion by using laser light. The thus obtained digital and analog latent images were developed to obtain an image having an analog image portion and a digital image portion.

In this instance, a magnetic toner was prepared in the following manner.

| | |
|---|---|
| Styrene/butyl acrylate/divinyl benzene copolymer (copolymerization wt. ratio: 80/19.5/0.5, weight-average molecular weight (Mw): 320,000) | 90 wt. parts |
| Styrene/butadiene/divinylbenzene copolymer (copolymerization wt. ratio: 80/19.5/0.5, Mw = 400,000) | 10 wt. parts |
| Magnetic iron oxide (predominantly comprising tri-iron tetraoxide, average particle size = about 0.2 micron) | 70 wt. parts |

-continued

| | |
|---|---|
| Nigrosin | 2 wt. parts |
| Low-molecular weight propylene-ethylene copolymer | 4 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using a jet air stream, and classified by a fixed-wall type wind-force classifier (DS-type Classifier, mfd. by Nippon Pneumatic Mfd. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain positively chargeable black fine powder (magnetic toner). The particle size distribution of the thus obtained magnetic toner is shown in the following Table 1 appearing hereinafter.

Separately, silica fine powder (Aerosil #200, mfd. by Nihon Aerosil K.K.) was treated with about 10 wt. % of amino-modified silicone oil to obtain hydrophobicity-imparted silica. 0.6 part of the resultant positively chargeable hydrophobic dry process silica (BET specific surface area: 200 $m^2/g$) was added to 100 parts of the magnetic toner of black fine powder obtained above and mixed therewith by means of a Henschel mixer.

The thus prepared magnetic toner was charged in the above-mentioned image forming apparatus and an image formation test was conducted. Such a test was repeated 5000 times by using A-4 sheets. The results are shown in Table 2 (analog image portion) and Table 3 (digital image portion) appearing hereinafter.

As apparent from these Tables, both of the analog and digital image portions provided good images without fog, wherein the line-expression characteristic, half-tone expression, and gradation characteristic were also excellent.

Figure 9:
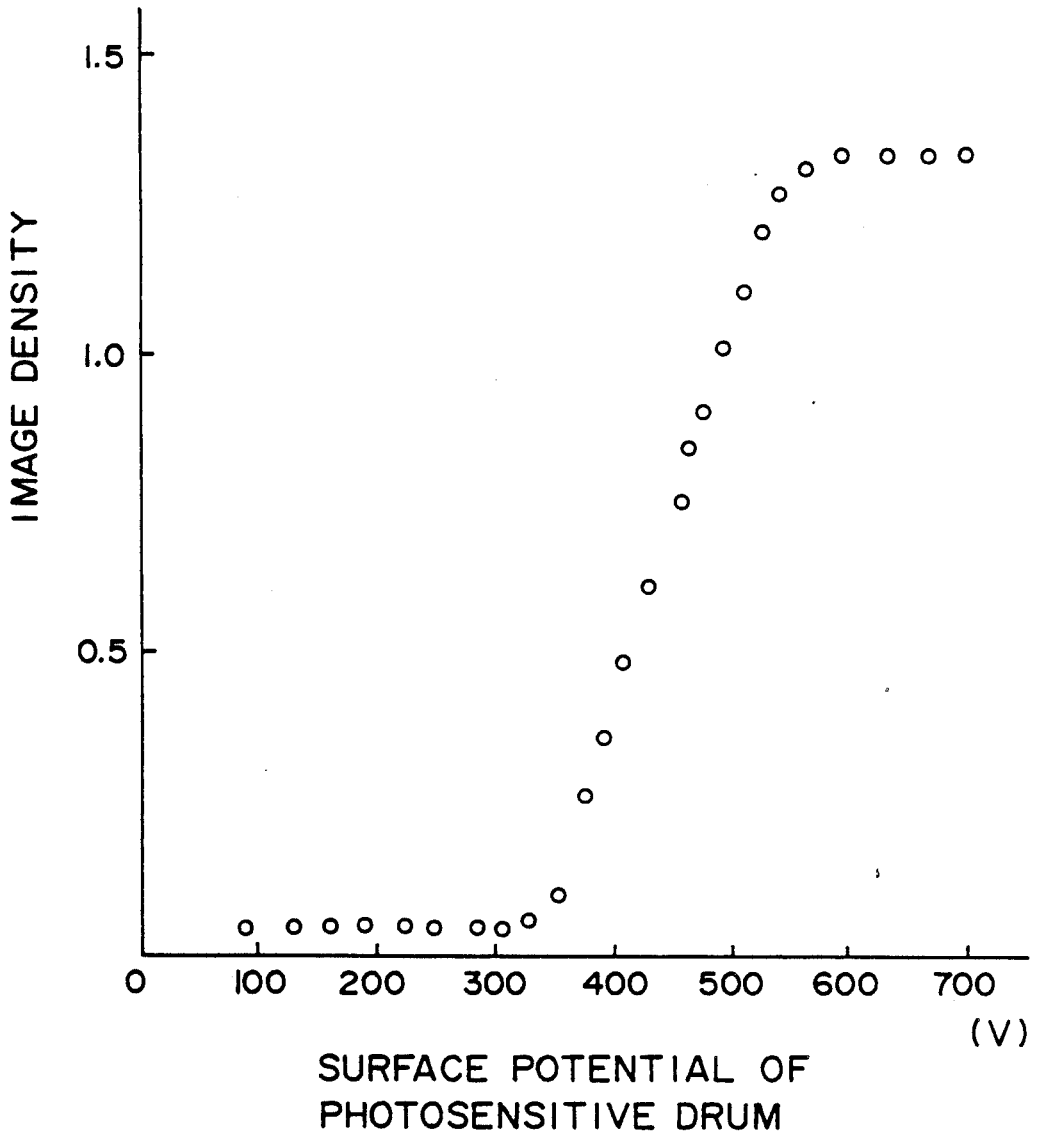
FIG. 9 is a graph obtained by plotting relationships between image densities and surface potentials of a photosensitive drum.

FIG. 9 shows a relationship between the surface potential of a photosensitive drum and an image density. More specifically, the quantity of light supplied from a halogen lamp was regulated by using a gray scale (i.e., a scale showing tones of white→ gray → black), so that various charge amounts were provided on the photosensitive member, and the surface potentials of the respective portions thereof were measured. Further, the respective portions having various potentials were developed and image densities corresponding to the respective potentials are determined.

EXAMPLES 2 AND 3

Two species of magnetic toners were prepared in the same manner as in Example 1 except that the amount of magnetic powder to be added thereto was changed and micropulverization and classification conditions were controlled to obtain toners having a particle size distribution as shown in Table 1 appearing hereinafter. Each of the thus obtained toners was subjected to an image formation test in the same manner as in Example 1.

As a result, as shown in Tables 2 and 3 appearing hereinafter, clear images were obtained with respect to the analog and digital image portions.

EXAMPLE 4

| | |
|---|---|
| Styrene/butyl acrylate/divinyl benzene copolymer (copolymerization wt. ratio: 75.0/24.0/1.0, weight-average molecular weight (Mw): 350,000) | 100 wt. parts |
| Magnetic iron oxide (average particle size = about 0.2 micron) | 80 wt. parts |
| Nigrosin | 3 wt. parts |
| Low-molecular weight ethylene-propylene copolymer | 4 wt. parts |

By using the above ingredients, a positively chargeable magnetic toner showing a particle size distribution as shown in Table 1 appearing hereinafter was prepared in the same manner as in Example 1. To the resultant magnetic toner, positively chargeable hydrophobic silica was externally added in the same manner as in Example 1.

The above-mentioned magnetic toner was subjected to an image formation test in the same manner as in Example 1 except for using a magnetic toner-carrying member comprising a sleeve obtained in the following manner in the image forming apparatus.

The surface of a stainless steel sleeve (SUS 304) was subjected to a blasting treatment for 2 min. In the blasting treatment, glass beads comprising 80% or more of particles having a diameter of 53–62 microns were used as regularly-shaped particles, the diameter of a blowing nozzle was 7 mm, the distance between the nozzle and the sleeve surface was 100 mm, and the air pressure was 4 $kg/cm^2$. As a result, unevenness comprising plural spherical impressions having a diameter R of 53–62 microns (according to optical microscope observation) was formed on the sleeve surface. The sleeve surface had an unevenness with a pitch P of 33 microns, and a surface roughness d of 2.0 microns.

The thus obtained results are shown in Tables 2 and 3 appearing hereinafter. As apparent from these Tables, high-density images without fog were obtained and the image quality thereof was also excellent.

EXAMPLES 5 AND 6

Two species of magnetic toners were prepared in the same manner as in Example 4 using the same materials as in Example 4 except that the amount of magnetic powder to be added thereto was changed and micropulverization and classification conditions were controlled to obtain toners having a particle size distribution as shown in Table 1 appearing hereinafter. The thus obtained toner was subjected to image formation test in the same manner as in Example 4.

As a result, as shown in Tables 2 and 3 appearing hereinafter, excellent image quality was obtained with respect to the analog and digital image portions.

COMPARATIVE EXAMPLE 1

A magnetic toners was prepared in the same manner as in Example 1 by using the same materials as in Example 1 except that the amount of magnetic powder to be added thereto was changed to 60 parts to obtain a toner having a particle size distribution as shown in Table 1 appearing hereinafter.

0.4 part of positively chargeable hydrophobic dry process silica (BET specific surface area: 200 $m^2/g$) was added to 100 parts of the magnetic toner obtained above and mixed therewith by means of a Henschel mixer. The thus obtained toner was subjected to image formation in the same manner as in Example 1.

As a result, as shown in Tables 2 and 3 appearing hereinafter, the line-expression characteristic, dot-expression characteristic and resolution were poor. Further, fog was observed in the digital image portion, and the halftone portion of the analog image was coarsened.

COMPARATIVE EXAMPLES 2–4

Toners having a particle size distribution as shown in Table 1 appearing hereinafter were obtained by using the coarsely crushed products obtained in Examples 1–6, while micropulverization and classification conditions were changed. The thus obtained toners were subjected to an image formation test in the same manner as in Example 4.

As a result, as shown in Tables 2 and 3 appearing hereinafter, good images could not be obtained. More specifically, Comparative Example 2 provided fog in the digital image portion, Comparative Example 3 provided deformation of the lines and dots due to excessive cover-up, and Comparative Example 4 provided fog.

COMPARATIVE EXAMPLE 5

A photosensitive member was obtained in the same manner as in Example 4 except that the compound represented by the formula (1) was removed the thus obtained photosensitive member was assembled in the image forming apparatus used in Example 4.

The magnetic toner obtained in Example 4 was charged in the thus obtained image forming apparatus and was subjected to image formation in the same manner as in Example 4.

As a result, as shown in Tables 2 and 3 appearing hereinafter, the analog image portion did not provide good images due to insufficient sensitivity but the digital image portion caused no problem.

Some physical properties of the above-mentioned toners obtained in Examples 1–6 and Comparative Examples are shown in Table 4 and the developing characteristics thereof are shown in Table 5.

TABLE 1

| | Amount of magnetic material (wt. parts) | Amount of silica (wt. parts) | Particle size distribution: % by number of particles ≦5 μm | % by volume of particles ≧16 μm | % by number of particles of 8–12.7 μm | Volume-average particle size (μm) |
|---|---|---|---|---|---|---|
| Ex. | | | | | | |
| 1 | 70 | 0.6 | 29.3 | 0.5 | 26.2 | 9.23 |
| 2 | 80 | 0.6 | 30.1 | 0.2 | 20.5 | 8.49 |
| 3 | 90 | 0.8 | 58.4 | 0.0 | 1.5 | 5.52 |
| 4 | 80 | 0.6 | 22.1 | 0.0 | 7.2 | 8.41 |
| 5 | 80 | 0.6 | 36.5 | 0.0 | 12.3 | 7.28 |
| 6 | 90 | 0.8 | 51.6 | 0.0 | 2.8 | 6.12 |
| Comp. Ex. | | | | | | |
| 1 | 60 | 0.4 | 9.9 | 5.1 | 57.7 | 11.37 |
| 2 | 70 | 0.6 | 15.3 | 6.3 | 28.0 | 9.89 |
| 3 | 80 | 0.6 | 8.8 | 0.0 | 37.4 | 8.66 |
| 4 | 80 | 0.6 | 65.5 | 1.0 | 12.0 | 8.28 |

TABLE 2

| | Evaluation of Analog Image: Initiation | | | | | At the time of 5000 sheets | | | | |
|---|---|---|---|---|---|---|---|---|---|---|
| | Density | Fog | Gradation characteristic | Thin-line reproducibility (%) | Resolution (line/mm) | Density | Fog | Gradation characteristic | Thin-line reproducibility (%) | Resolution line/mm |
| Ex. | | | | | | | | | | |
| 1 | 1.32 | o | o | 108 | 5.6 | 1.36 | o | o | 107 | 5.6 |
| 2 | 1.34 | o | o | 105 | 6.3 | 1.37 | o | o | 106 | 6.3 |
| 3 | 1.30 | o | o | 101 | 7.1 | 1.31 | o | o | 102 | 7.1 |
| 4 | 1.38 | o | o | 103 | 6.3 | 1.42 | o | o | 105 | 6.3 |
| 5 | 1.35 | o | o | 100 | 6.3 | 1.39 | o | o | 103 | 6.3 |
| 6 | 1.32 | o | o | 104 | 7.1 | 1.35 | o | o | 102 | 7.1 |
| Comp. Ex. | | | | | | | | | | |
| 1 | 1.33 | o | Δ | 130 | 4.5 | 1.31 | o | Δ | 150 | 4.0 |
| 2 | 1.25 | Δ | o | 115 | 4.0 | 1.28 | o | o | 120 | 4.0 |
| 3 | 1.38 | o | Δ | 112 | 5.6 | 1.41 | o | Δ | 118 | 4.5 |
| 4 | 1.27 | Δ | o | 105 | 6.3 | 1.22 | Δ | o | 106 | 6.3 |
| 5 | 1.37 | x | x | 109 | 5.6 | — | — | — | — | — |

TABLE 3

| | Evaluation of Digital Image: Initial stage | | | | | At the time of 5000 sheets | | | | |
|---|---|---|---|---|---|---|---|---|---|---|
| | Density | Fog | Dot expression | Line expression (%) | Resolution | Density | Fog | Dot expression | Line expression (%) | Resolution |
| Ex. | | | | | | | | | | |
| 1 | 1.32 | o | 1 | 110 | o | 1.35 | o | 1 | 111 | o |
| 2 | 1.35 | o | 1 | 107 | o | 1.37 | o | 1 | 105 | o |

TABLE 3-continued

| | Evaluation of Digital Image | | | | | | | | | |
|---|---|---|---|---|---|---|---|---|---|---|
| | Initial stage | | | | | At the time of 5000 sheets | | | | |
| | Density | Fog | Dot expression | Line expression (%) | Resolution | Density | Fog | Dot expression | Line expression (%) | Resolution |
| 3 | 1.30 | o | 1 | 102 | o | 1.31 | o | 1 | 104 | o |
| 4 | 1.37 | o | 1 | 105 | o | 1.40 | o | 1 | 108 | o |
| 5 | 1.36 | o | 1 | 108 | o | 1.40 | o | 1 | 106 | o |
| 6 | 1.31 | o | 1 | 103 | o | 1.36 | o | 1 | 105 | o |
| Comp. Ex. | | | | | | | | | | |
| 1 | 1.34 | Δ | 2 | 140 | x | 1.30 | Δ | 2 | 155 | x |
| 2 | 1.25 | x | 2 | 120 | Δ | 1.27 | Δ | 2 | 130 | x |
| 3 | 1.39 | o | 2 | 115 | o | 1.40 | o | 2 | 120 | Δ |
| 4 | 1.25 | x | 1 | 103 | o | 1.23 | x | 1 | 109 | o |
| 5 | 1.37 | o | 1 | 106 | o | — | — | — | — | — |

In the above Tables 2 and 3, the symbols have the following meanings.

Fog and gradation characteristic

These characteristics were evaluated by using naked eye observation.

o . . . good

Δ . . . ordinary x . . . not good

Resolution (Table 3)

o . . . The line image was clearly observed.

Δ . . . The line image was not clear but practically usable.

x . . . The line image was very unclear.

TABLE 4

| | Triboelectric charge (μc/g) | True density (g/cm³) | Magnetic characteristics $\sigma_r$ (emu/g) | $\sigma_s$ (emu/g) | $H_c$ (Oe) |
|---|---|---|---|---|---|
| Ex. | | | | | |
| 1 | 11.7 | 1.47 | 1.3 | 25 | 50 |
| 2 | 12.1 | 1.52 | 1.5 | 26 | 50 |
| 3 | 13.4 | 1.59 | 1.7 | 28 | 51 |
| 4 | 10.5 | 1.53 | 2.8 | 25 | 90 |
| 5 | 11.2 | 1.53 | 2.8 | 25 | 91 |
| 6 | 12.8 | 1.58 | 3.2 | 27 | 91 |
| Comp. Ex. | | | | | |
| 1 | 12.3 | 1.42 | 1.2 | 21 | 49 |
| 2 | 9.9 | 1.48 | 2.4 | 23 | 90 |
| 3 | 13.6 | 1.52 | 2.8 | 25 | 91 |
| 4 | 11.7 | 1.54 | 2.7 | 26 | 90 |

TABLE 5

| | Initial stage | | | | At the time of 5000 sheets | | | |
|---|---|---|---|---|---|---|---|---|
| | $V_{H-L}$ | $D_H$ | $V_{H-D}$ | $V_{L-D}$ | $V_{L-H}$ | $D_H$ | $V_{H-D}$ | $V_{L-D}$ |
| Ex. | | | | | | | | |
| 1 | 90 | 0.060 | 50 | 310 | 90 | 0.062 | 40 | 300 |
| 2 | 90 | 0.085 | 70 | 290 | 80 | 0.079 | 60 | 280 |
| 3 | 90 | 0.073 | 70 | 300 | 90 | 0.080 | 70 | 290 |
| 4 | 70 | 0.075 | 50 | 260 | 60 | 0.070 | 30 | 240 |
| 5 | 70 | 0.072 | 40 | 260 | 70 | 0.076 | 40 | 250 |
| 6 | 80 | 0.067 | 50 | 290 | 80 | 0.071 | 50 | 280 |
| Comp. Ex. | | | | | | | | |
| 1 | 120 | 0.110 | 50 | 280 | 120 | 0.115 | 150 | 370 |
| 2 | 150 | 0.080 | 60 | 340 | 120 | 0.080 | 50 | 300 |
| 3 | 70 | 0.112 | 40 | 220 | 80 | 0.121 | 40 | 210 |
| 4 | 150 | 0.077 | 70 | 350 | 170 | 0.062 | 30 | 370 |

EXAMPLE 7

A photosensitive drum was prepared in the same manner as in Example 1 except that a bisazo pigment (3) was used instead of the bisazo pigment (5). By using the thus prepared photosensitive drum, a latent image was developed in the same manner as in Example 1, whereby good results similar to those of Example 1 were obtained.

What is claimed is:

1. An image forming method, comprising:

providing an electrophotographic photosensitive member comprising an organic photoconductor, and a toner-carrying member carrying thereon a magnetic toner disposed opposite to the photosensitive member with a predetermined clearance in a developing region; said photosensitive member comprising at least two species of charge-generating substances and carrying thereon a digital and an analog electrostatic images;

carrying the magnetic toner on the toner-carrying member to the developing region while regulating the magnetic toner so as to provide a thickness smaller than said clearance; said magnetic toner having a particle size distribution such that it comprises 12–60% by number of magnetic toner particles having a particle size of 5 microns or smaller, 1–33% by number of magnetic toner particles having a particle size of 8–12.7 microns, and 2.0% by volume or less of magnetic toner particles having a particle size of 16 microns or larger, and has a volume-average particle size of 4–10 microns; and developing the electrostatic images with said magnetic toner.

2. An image forming method according to claim 1, wherein said charge-generating substances comprise a compound having a spectral sensitivity in a visible light region, and a compound having a spectral sensitivity in an infrared region.

3. An image forming method according to claim 2, wherein said charge-generating substances comprise a bisazo-type compound having a spectral sensitivity in the region of 400–700 nm, and a bisazo-type compound having a spectral sensitivity in the region of 700–900 nm.

4. An image forming method according to claim 3, wherein said charge-generating substances comprise a bisazo-type pigment containing a oxadiazole ring as a central skeleton, and a bisazo-type pigment containing a benzanthrone ring or diphenyl-pyridine-2-yl-amine as a central skeleton.

5. An image forming method according to claim 1, wherein the photosensitive member comprising an organic photoconductor contains a triphenylamine-type compound as a charge-transporting substance.

6. An image forming method according to claim 1, wherein the magnetic toner comprises 25–50% by number of magnetic toner particles having a particle size of 5 microns or smaller, 8–20% by number of magnetic toner particles having a particle size of 8–12.7 microns, and 1.0% by volume or less of magnetic toner particles having a particle size of 16 microns or larger.

7. An image forming method according to claim 6, wherein the magnetic toner comprises 35–50% by number of magnetic toner particles having a particle size of 5 microns or smaller, and 0.5% by volume or less of magnetic toner particles having a particle size of 16 microns or larger.

8. An image forming method according to claim 1, wherein the magnetic toner comprises 100 wt. parts of a resin component and 60–120 wt. parts of a magnetic material.

9. An image forming method according to claim 1, wherein the magnetic toner comprises 100 wt. parts of a resin component and 65–110 wt. parts of a magnetic material.

10. An image forming method according to claim 1, wherein the magnetic toner has a true density of 1.45–1.70 g/cm$^3$.

11. An image forming method according to claim 1, wherein the magnetic toner has a true density of 1.50–1.65 g/cm$^3$.

12. An image forming method according to claim 1, wherein the magnetic toner has a residual magnetization ($\sigma_r$) of 1–5 emu/g, a saturation magnetization ($\sigma_s$) of 20–40 emu/g and a coercive force (Hc) of 40–100 Öe.

13. An image forming method according to claim 1, wherein the magnetic toner comprises magnetic toner particles having silica fine powder on the surface thereof.

14. An image forming method according to claim 13, wherein the magnetic toner comprises a positively chargeable magnetic toner comprising positively chargeable magnetic toner particles having positively chargeable silica fine powder on the surface thereof.

15. An image forming method according to claim 1, wherein the magnetic toner carried on the toner-carrying member has a developing characteristic such that it has a $V_{H-L}$ of 100 V or lower, a $D_H$ of below 0.11, a $V_{H-D}$ of 100 V or lower, and a $V_{L-D}$ of 400 V or lower.

16. An image forming method according to claim 1, wherein the photosensitive member carries a latent image having a latent image potential of 550–750 V in the black image portion.

17. An image forming method according to claim 1, wherein the magnetic toner has a triboelectric charging characteristic of 5–20 μc/g in terms of the absolute value of a triboelectric charge amount.

18. An image forming method according to claim 1, wherein the toner-carrying member has a surface having a plurality of spherical impressions.

* * * * *

UNITED STATES PATENT AND TRADEMARK OFFICE

CERTIFICATE OF CORRECTION

PATENT NO. : 4,999,272

DATED : March 12, 1991

INVENTOR(S) : HIROHIDE TANIKAWA, ET AL.

It is certified that error appears in the above-identified patent and that said Letters Patent is hereby corrected as shown below:

Title Page:

IN [57] ABSTRACT

Line 9, "images;" should read --image;--.

COLUMN 1

Line 31, "an" should read --a--.

COLUMN 6

Line 16, "and" should be deleted.

COLUMN 9

Line 18, "1214 60%" should read --12-60%--.

COLUMN 16

Line 4, "1.45 b/$cm^3$" should read --1.45 g/$cm^3$--.
Line 13, "ears" should read --"ears"--.

COLUMN 18

Line 21, "(Pittsuburgh" should read --(Pittsburgh--.
Line 22, "Fulstoff-Gesellshaft" should read --Fulstoff-Gesellschaft--.
Line 28, "(Philadilphia" should read --(Philadelphia--.
Line 58, "groups" should read --group--.

--

UNITED STATES PATENT AND TRADEMARK OFFICE

CERTIFICATE OF CORRECTION

PATENT NO. : 4,999,272

DATED : March 12, 1991

INVENTOR(S) : HIROHIDE TANIKAWA, ET AL.

It is certified that error appears in the above-identified patent and that said Letters Patent is hereby corrected as shown below:

COLUMN 19

Line 11, "denotes" should --denote--.

COLUMN 22

Line 29, "have" should read --has--.

COLUMN 24

Line 4, "a" (second occurrence) should be deleted.

COLUMN 26

Line 58, "ia" should read --a--.

COLUMN 28

Line 14, "tin lines" should read --thin lines--.
Line 36, "photosensitive" should read --photosensitive member--.

COLUMN 30

Line 59, "toners" should read --toner--.

--

UNITED STATES PATENT AND TRADEMARK OFFICE

CERTIFICATE OF CORRECTION

PATENT NO. : 4,999,272

DATED : March 12, 1991

INVENTOR(S) : HIROHIDE TANIKAWA, ET AL.

It is certified that error appears in the above-identified patent and that said Letters Patent is hereby corrected as shown below:

COLUMN 34

Line 37, "images;" should read --image;--.

Signed and Sealed this

Eighth Day of December, 1992

*Attest:*

*Attesting Officer*

DOUGLAS B. COMER

*Acting Commissioner of Patents and Trademarks*